US008960673B2

(12) United States Patent
Yoshida

(10) Patent No.: US 8,960,673 B2
(45) Date of Patent: Feb. 24, 2015

(54) IMAGE FORMING APPARATUS

(71) Applicant: KYOCERA Document Solutions Inc., Osaka (JP)

(72) Inventor: Takeshi Yoshida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/092,570

(22) Filed: Nov. 27, 2013

(65) Prior Publication Data

US 2014/0151955 A1 Jun. 5, 2014

(30) Foreign Application Priority Data

Nov. 30, 2012 (JP) ..... 2012-262694

(51) Int. Cl.

| | |
|---|---|
| ***B65H 39/10*** | (2006.01) |
| ***G03G 15/00*** | (2006.01) |
| ***B65H 29/12*** | (2006.01) |
| ***B65H 29/58*** | (2006.01) |
| ***B65H 31/22*** | (2006.01) |
| ***B65H 85/00*** | (2006.01) |

(52) U.S. Cl.

CPC ..... *G03G 15/6576* (2013.01); *B65H 29/125* (2013.01); *B65H 29/58* (2013.01); *B65H 31/22* (2013.01); *B65H 85/00* (2013.01); *G03G 15/6552* (2013.01); *B65H 2301/446* (2013.01); *B65H 2402/441* (2013.01); *B65H 2404/693* (2013.01); *B65H 2601/11* (2013.01); *B65H 2801/06* (2013.01)

USPC ..... 271/303; 271/225; 271/306

(58) Field of Classification Search

USPC ..... 271/302, 303, 305, 225, 306; 270/58.01

See application file for complete search history.

(56) References Cited

U.S. PATENT DOCUMENTS

| | | | | |
|---|---|---|---|---|
| 3,948,505 | A * | 4/1976 | Miller et al. | 271/303 |
| 4,424,966 | A * | 1/1984 | Chandhoke | 271/302 |
| 5,263,708 | A * | 11/1993 | Hacknauer | 271/303 |
| 5,553,528 | A * | 9/1996 | Zoltner | 83/443 |
| 5,947,464 | A * | 9/1999 | Takada | 271/3.03 |
| 6,045,127 | A * | 4/2000 | Fukui | 271/303 |
| 6,244,594 | B1 * | 6/2001 | Araseki et al. | 271/293 |
| 8,152,169 | B2 * | 4/2012 | Samoto et al. | 271/301 |

FOREIGN PATENT DOCUMENTS

JP 2005-194089 A 7/2005

* cited by examiner

*Primary Examiner* — Jeremy R Severson

(74) *Attorney, Agent, or Firm* — Studebaker & Brackett PC

(57) ABSTRACT

An image forming apparatus includes a relay unit and a guide plate. The relay unit is detachably mounted in the in-body discharge section and receives a sheet discharged from the first exit port and conveys the sheet. The guide plate switches a conveyance path for the sheet discharged from the first exit port between a first path via the relay unit and a second path other than the first path. The relay unit includes a conveyance roller and a drive device. The conveyance roller conveys the sheet. The drive device rotates the conveyance roller. The drive device changes the posture of the guide plate between a first posture corresponding to the first path and a second posture corresponding to the second path.

15 Claims, 21 Drawing Sheets

IMAGE FORMING APPARATUS

INCORPORATION BY REFERENCE

The present application claims priority under 35 U.S.C. §119 to Japanese Patent Application No. 2012-262694, filed Nov. 30, 2012. The contents of this application are incorporated herein by reference in their entirety.

BACKGROUND

The present disclosure relates to image forming apparatuses including an apparatus body, in which an in-body discharge space is formed, for performing image forming processing on a sheet and a post processing device for performing post processing on the sheet.

In-body discharge type image forming apparatuses include an apparatus body in the interior of which a space (in-body discharge space) is formed so that a sheet after image formation is discharged. In an in-body discharge type image forming apparatus, a sheet try, etc. is not projected from the apparatus body. Thus, it can bring advantage of small space occupancy and high accommodation capacity. Meanwhile, a post processing device may be optionally mounted in the in-body discharge type image forming apparatus after assembling in some cases. The post processing device performs post processing on a sheet, such as punch processing and staple processing. In general, since a sheet exit port opens toward the in-body discharge space, which is small, it is difficult to mount the post processing device inside the in-body discharge space.

Accordingly, when a post processing device is mounted after assembling, the post processing device is mounted on a side wall of the apparatus body of the image forming apparatus and a relay unit having a sheet conveyance function is mounted in the in-body discharge space. The side wall on which the post processing device is mounted is a side wall on the opposite side of a side wall where the sheet exit port is provided.

A sheet is conveyed to the post processing device from the exit port via a relay unit. The relay unit may entirely occupy the in-body discharge space. However, in many cases, the relay unit is mounted to the apparatus body so as to occupy part of the in-body discharge space and leave a lower region of the in-body discharge space. In the latter case, a branching mechanism is provided in the vicinity of a sheet reception port of the relay unit. The branching mechanism switches a sheet conveyance path between a path in which a sheet is conveyed to the relay unit (post processing device) and a path in which a sheet is discharged to an in-body discharge section.

In general, a method for swinging a guide plate arranged at a branching point of the conveyance path is employed for switching the sheet conveyance path. A simple mechanism to drive to make the guide plate swing is a drive mechanism which utilizes a solenoid. However, in this drive mechanism, delay time must be taken into account in operation of a movable piece of the solenoid. Further, a member for reducing operation noise and a member for mounting a peripheral mechanism are needed, which may increase the cost.

An image forming apparatus employs a mechanism using a stepping motor as a drive mechanism to swing a guide plate. With this drive mechanism, the operation delay can be prevented, and a posture of the guide plate can be controlled with high precision.

SUMMARY

An image forming apparatus according to an aspect of the present disclosure includes: an apparatus body, an in-body discharge section, a first exit port, and a relay unit. The apparatus body performs image forming processing on a sheet. The in-body discharge section is formed in the apparatus body as in-body space having an opening opened outward of the apparatus body and is capable of accommodating the sheet on which the image forming processing has been performed. The first exit port is formed in the apparatus body and opened toward the in-body space. The relay unit is detachably mounted in the in-body discharge section and receives a sheet discharged from the first exit port and conveys the sheet.

The relay unit includes: a relay conveyance path, a conveyance roller, a drive device, and a guide plate. The sheet passes the relay conveyance path. The conveyance roller is provided in the relay conveyance path and conveys the sheet in the relay conveyance path. The drive device rotates the conveyance roller. The guide plate switches a conveyance path for a sheet discharged from the first exit port between a first path via the relay unit and a second path other than the first path. The drive device changes the posture of the guide plate between a first posture corresponding to the first path and a second posture corresponding to the second path.

DETAILED DESCRIPTION

Figure 1:
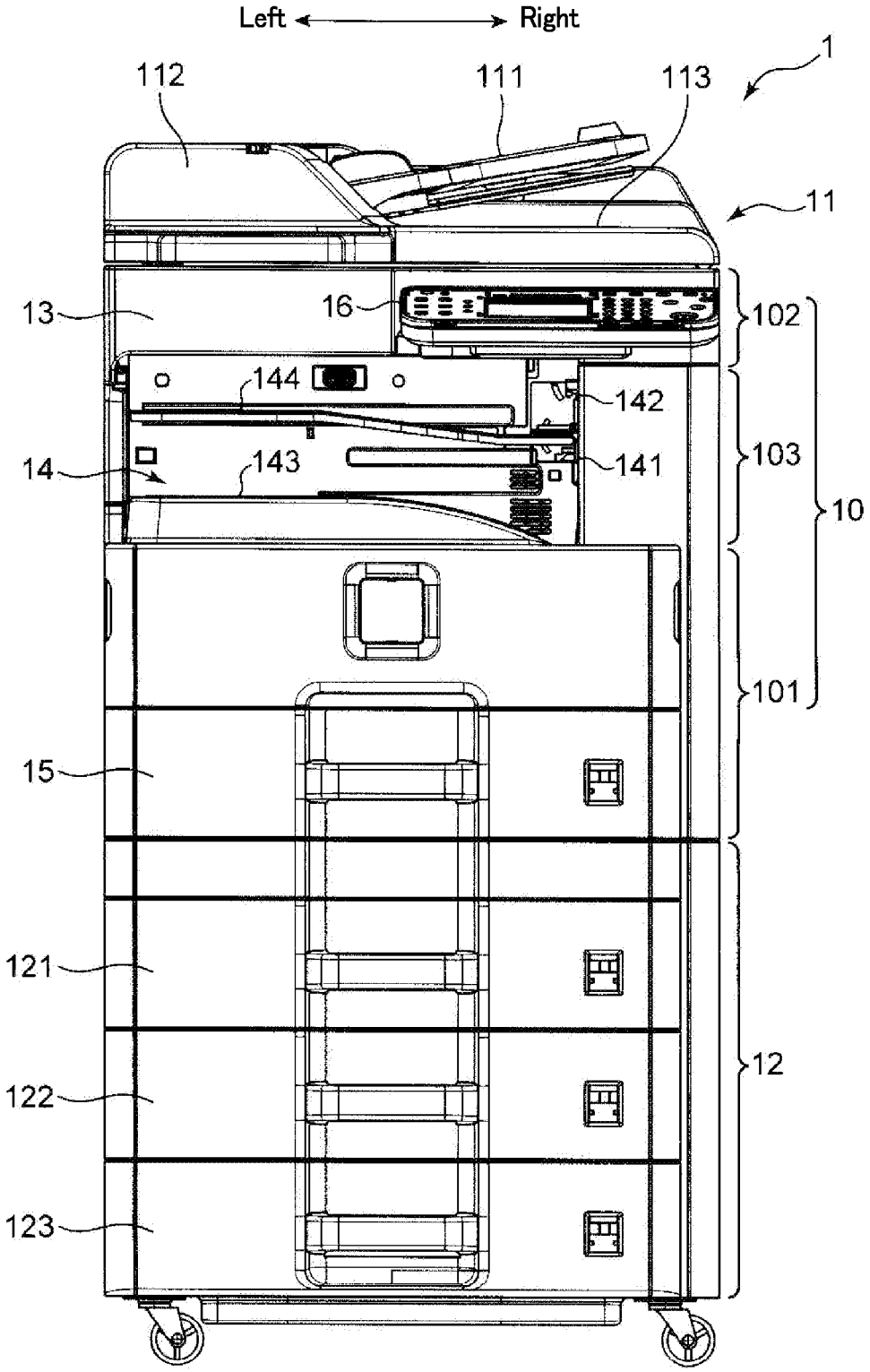
FIG. 1 is a front view showing an external appearance of an apparatus body of an image forming apparatus in one embodiment of the present disclosure before a post processing device is mounted.

Hereinafter, embodiments of the present disclosure will be specifically described with reference to the accompanying drawings. FIG. 1 is a front view showing an external appearance of an apparatus body 1 of an image forming apparatus. In the image forming apparatus according to the present disclosure, a post processing device 40 and a relay unit 50 are fitted to the apparatus body 1 (see FIG. 3). However, the apparatus body 1 before the post processing device 40 and the relay unit 50 are fitted thereto will be described first. The apparatus body 1 performs image forming processing on a sheet. The description thereof will be described specifically below.

The apparatus body 1 of the image forming apparatus is a monochrome copier, for example. The apparatus body 1 includes a substantially rectangular parallelepiped body housing 10, an automatic document feeder 11, and an expanded paper feed unit 12. The automatic document feeder 11 is arranged on the upper surface of the body housing 10. The expanded paper feed unit 12 is arranged on the lower surface of the body housing 10. The body housing 10 serves as a casing and accommodates various types of devices for performing image forming processing on a sheet.

The automatic document feeder 11 automatically conveys a document sheet as a copy target via an image reading point. The image reading point is set in the upper surface of the body housing 10. The automatic document feeder 11 includes a document tray 111, a document conveyance section 112, and a document discharge tray 113. Document sheets are loaded on the document tray 111. The document conveyance section 112 automatically conveys the document sheets on a sheet-by-sheet basis via the image reading point. Each document sheet, which has been read, is discharged to the document discharge tray 113.

The expanded paper feed unit 12 is a unit to be expanded for automatically feeding a large number of same size sheets in order to automatically feed various types of different size sheets. For example, the expanded paper feed unit 12 includes a paper feed cassette 121, a paper feed cassette 122, and a paper feed cassette 123, which are arranged in the vertical direction in three stage cassettes. Each of the paper feed cassettes 121-123 can accommodate a sheet sheaf.

Figure 2:
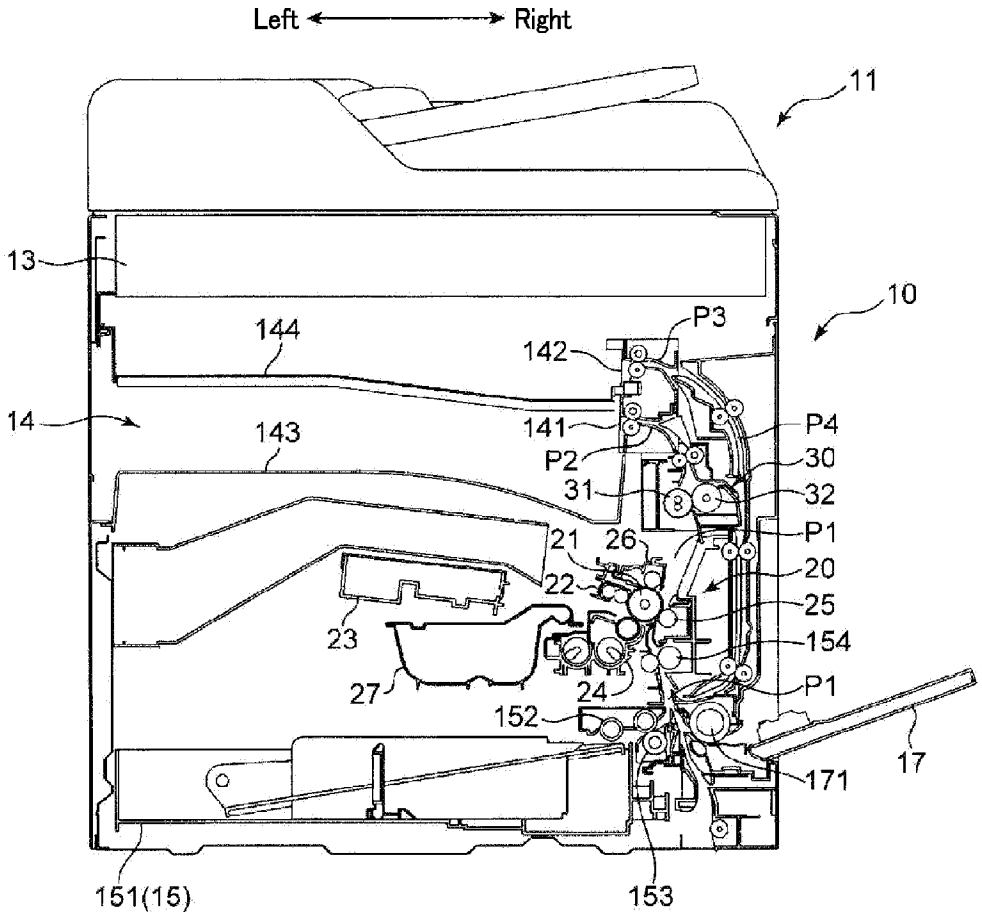
FIG. 2 is a cross sectional view showing an internal structure of the apparatus body of the image forming apparatus in one embodiment of the present disclosure.

The body housing 10 includes a substantially rectangular parallelepiped lower casing 101, a substantially rectangular parallelepiped upper casing 102, and a joint casing 103. The upper casing 102 is arranged above the lower casing 101. The joint casing 103 joins the lower casing 101 and the upper casing 102. A various types of devices for transferring a toner image to a sheet, which will be described with reference to FIG. 2, are accommodated in the lower casing 101. A scanner for optically reading an image of a document sheet is accommodated in the upper casing 102.

An in-body discharge section 14 is formed in the apparatus body 1. The in-body discharge section 14 is formed as an in-body space surrounded by the lower casing 101, the upper casing 102, and the joint casing 103, and is capable of accommodating a sheet, on which image forming processing has been performed. The joint casing 103 is arranged on the right side surface of the apparatus body 1. A first exit port 141 and a second exit port 142 are formed in the joint casing 103 of the apparatus body 1. The first exit port 141 is open toward an in-body space to discharge a sheet to the in-body discharge section 14. The second exit port 142 is open toward the in-body space at a position higher than the position of the first exit port 141.

The in-body space used as the in-body discharge section 14 is open outward of the apparatus body 1. Specifically, the in-body space has an opening opened outward of the apparatus body 1 on the front surface and the left side surface of the apparatus body 1. In a state in which the post processing device 40 and the relay unit 50 are not fitted to the apparatus body 1, a user can insert his/her hand through the opening to take out an image formed sheet from the in-body discharge section 14.

The upper surface of the lower casing 101 defines the bottom of the in-body space. This upper surface functions as an in-body discharge tray 143. That is, the in-body discharge tray 143 defines the bottom of the in-body space. A sheet discharged from the first exit port 141 is loaded on the in-body discharge tray 143. A sub paper discharge tray 144 is fitted above the in-body discharge tray 143. A sheet discharged from the second exit port 142 is loaded on the sub paper discharge tray 144. Or, a sheet to be subjected to duplex printing is temporarily discharged to the sub paper discharge tray 144 for switchback conveyance.

A paper feed cassette 15 is detachably fitted to the lower casing 101. The paper feed cassette 15 accommodates a sheet to be subjected to image forming processing. Further, an operation section 16 protrudes frontward from the front surface of the upper casing 102. The operation section 16 includes an LCD touch panel, a numeric keypad, a start key, etc. The operation section 16 receives an input of various types of operation instructions from a user.

FIG. 2 is a cross sectional view showing an internal structure of the apparatus body 1 shown in FIG. 1. It is noted that the expanded paper feeding unit 12 is not shown in FIG. 2. In addition to the scanner 13 and the paper feed cassette 15, an image forming section 20, a fusing section 30, and a sheet conveyance path are accommodated in the body housing 10 of the apparatus body 1.

The image forming section 20 includes a photosensitive drum 21, a charger 22, an exposure unit 23, a development device 24, a transfer roller 25, and a cleaning device 26. The charger 22, the exposure unit 23, the development device 24, the transfer roller 25, the cleaning device 26 are arranged around the photosensitive drum 21.

The photosensitive drum 21 rotates about its axis. The photosensitive drum 21 has a peripheral surface on which an electrostatic latent image and a toner image are formed. The charger 22 uniformly and electrically charges the peripheral surface of the photosensitive drum 21. The exposure unit 23 irradiates laser light to the peripheral surface of the photosensitive drum 21 to form an electrostatic latent image. The development device 24 supplies toner to the peripheral surface of the photosensitive drum 21 to develop the electrostatic latent image formed on the photosensitive drum 21. The transfer roller 25 forms a transfer nip in cooperation with the photosensitive drum 21 and transfers the toner image on the photosensitive drum 21 to a sheet. The cleaning device 26 cleans the peripheral surface of the photosensitive drum 21 after the toner image is transferred. A tonner container 27 is arranged adjacent to the development device 24. The tonner container 27 supplies toner to the development device 24.

The fusing section 30 is arranged inside the joint casing 103. The fusing section 30 heats and presses a sheet to perform fusing. Specifically, the fusing section 30 includes a fusing roller 31 and a pressure roller 32. A heat source is built in the fusing roller 31. The pressure roller 32 forms a fusing nip in cooperation with the fusing roller 31. The fusing section 30 heats and presses a sheet, to which a toner image has been transferred in the transfer nip, in the fusing nip to fuse the sheet. The sheet subjected to fuse is discharged to the in-body discharge section 14 from the first exit port 141 or the second exit port 142.

The sheet conveyance path includes a main conveyance path P1. The main conveyance path P1 extends from the vicinity the lower part of the body housing 10 to the vicinity of the upper part thereof in the vertical direction via the image forming section 20 and the fusing section 30. A first exit conveyance path P2 branches in the vicinity of the downstream end of the main conveyance path P1. The first exit conveyance path P2 guides a sheet to the first exit port 141. Further, a second exit conveyance path P3 is connected to the most downstream end (upper end) of the main conveyance path P1. The second exit conveyance path P3 guides a sheet to the second exit port 142. Further, a reverse conveyance path P4 extends from the most downstream end of the main conveyance path P1 to the vicinity of the upstream end thereof. The reverse conveyance path P4 conveys a sheet to be subjected to duplex printing in a reverse direction.

The paper feed cassette 15 includes a sheet accommodation section 151. The sheet accommodation section 151 accommodates a sheet sheaf. A pickup roller 152 and a pair of paper feeding rollers 153 are provided near the upper right side of the sheet accommodation section 151. The pickup roller 152 feeds out an uppermost sheet in the sheet sheaf on a sheet-by-sheet basis. The pair of paper feeding rollers 153 sends out the sheet fed out by the pickup roller 152 to the upstream end of the main conveyance path P1.

Further, a manual paper feed tray 17 for manual feeding is provided on the right side surface of the body housing 10. A manual paper feeding roller 171 sends out a sheet loaded on the manual paper feed tray 17 to the upstream end of the main conveyance path P1. A pair of registration rollers 154 is arranged upstream of the image forming section 20 in the main conveyance path P1. The pair of registration rollers 154 sends out a sheet to the transfer nip with predetermined timing.

When simplex printing (simplex image formation) is performed on a sheet, the sheet is sent out from the sheet accommodation section 151 or the manual paper feed tray 17 to the main conveyance path P1. Then, the image forming section 20 performs transferring processing to transfer a toner image to the sheet. Further, the fusing section 30 performs fusing processing to fuse the transferred toner image to the sheet. Then, the sheet is discharged onto the in-body discharge tray 143 from the first exit port 141 via the first exit conveyance path P2.

By contrast, when duplex printing (duplex image formation) is performed on a sheet, part of the sheet is discharged onto the sub paper discharge tray 144 from the second exit port 142 via the second exit conveyance path P3 after the transferring processing and the fusing processing on one side of the sheet. Thereafter, the sheet is conveyed in a switchback manner and returned to the vicinity of the upstream end of the main conveyance path P1 via the reverse conveyance path P4. Then, transferring processing and fusing processing are performed on the other side of the sheet. Then the sheet is discharged onto the in-body discharge tray 143 from the first exit port 141 via the first exit conveyance path P2.

Figure 3:
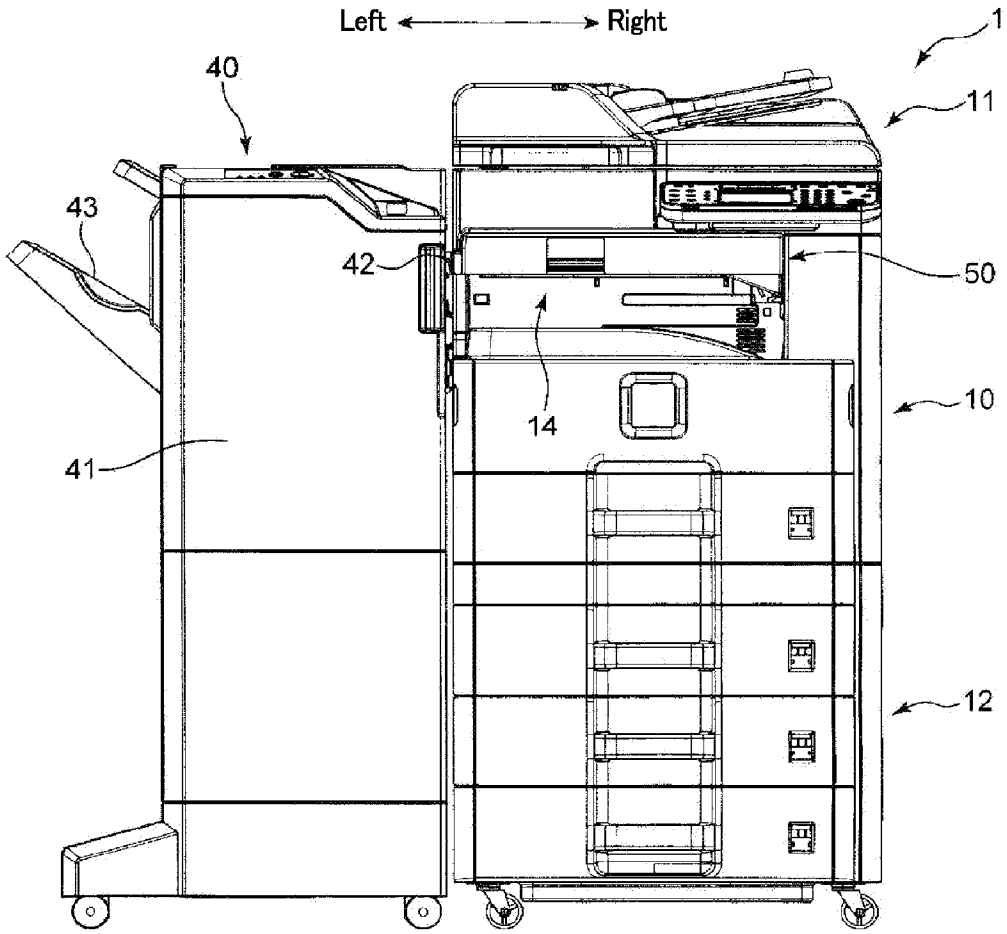
FIG. 3 is a front view showing an external appearance of the image forming apparatus with the post processing device and a relay unit fitted in one embodiment of the present disclosure.

FIG. 3 is a front view showing an external appearance of the image forming apparatus with the post processing device 40 and the relay unit 50 fitted to the apparatus body 1. The post processing device 40 is mounted on the left side surface of the apparatus body 1. The post processing device 40 is a device for performing post processing (e.g., predetermined post processing) on an image formed sheet. The predetermined post processing is punch processing or staple processing. The relay unit 50 is detachably mounted in the in-body discharge section 14. The relay unit 50 receives a sheet discharged from the first exit port 141 and conveys the sheet. In other words, the relay unit 50 conveys the image formed sheet from the apparatus body 1 to the post processing device 40.

The post processing device 40 is a unit which can be optionally mounted in the apparatus body 1 after assembling. The post processing device 40 includes a post processing device main body 41. The post processing device main body 41 includes a post processing section for performing punch processing and staple processing, etc. therein. The post processing device main body 41 includes a reception port 42 on its right side surface. The reception port 42 receives a sheet. The post processing device main body 41 includes a paper discharge tray 43 on its left side surface. The sheet, on which the post processing has been performed, is discharged to the paper discharge tray 43. The post processing device main body 41 performs the post processing on the sheet received at the reception port 42, and then discharges the sheet to the paper discharge tray 43.

The relay unit 50 is also a unit which can be optionally mounted in the apparatus body 1 when the post processing device 40 is mounted after assembling. The relay unit 50 is mounted in the in-body discharge section 14. The relay unit 50 receives a sheet from the first exit port 141 and conveys the sheet to the reception port 42 of the post processing device 40. Specifically, the relay unit 50 receives a sheet from the first exit port 141 of the apparatus body 1, conveys the sheet in the horizontal direction across the in-body space (in-body discharge section 14) and conveys the sheet to the reception port 42 of the post processing device 40.

In order to mount the relay unit 50, the sub paper discharge tray 144 is removed, and then the relay unit 50 is fitted around the position where the sub paper discharge tray 144 has been fitted. The details are as follows.

The in-body space includes a lower region immediately above the in-body discharge tray 143 and an upper region above the lower region along the perpendicular line. Further, the relay unit 50 is arranged in the upper region. The lower region is not occupied by the relay unit 50 and remains open. Accordingly, even when the relay unit 50 is fitted, a sheet can be discharged onto the in-body discharge tray 143 via the lower region from the first exit port 141. It is noted that a guide plate 80 is arranged to face the in-body discharge tray 143.

Figure 4:
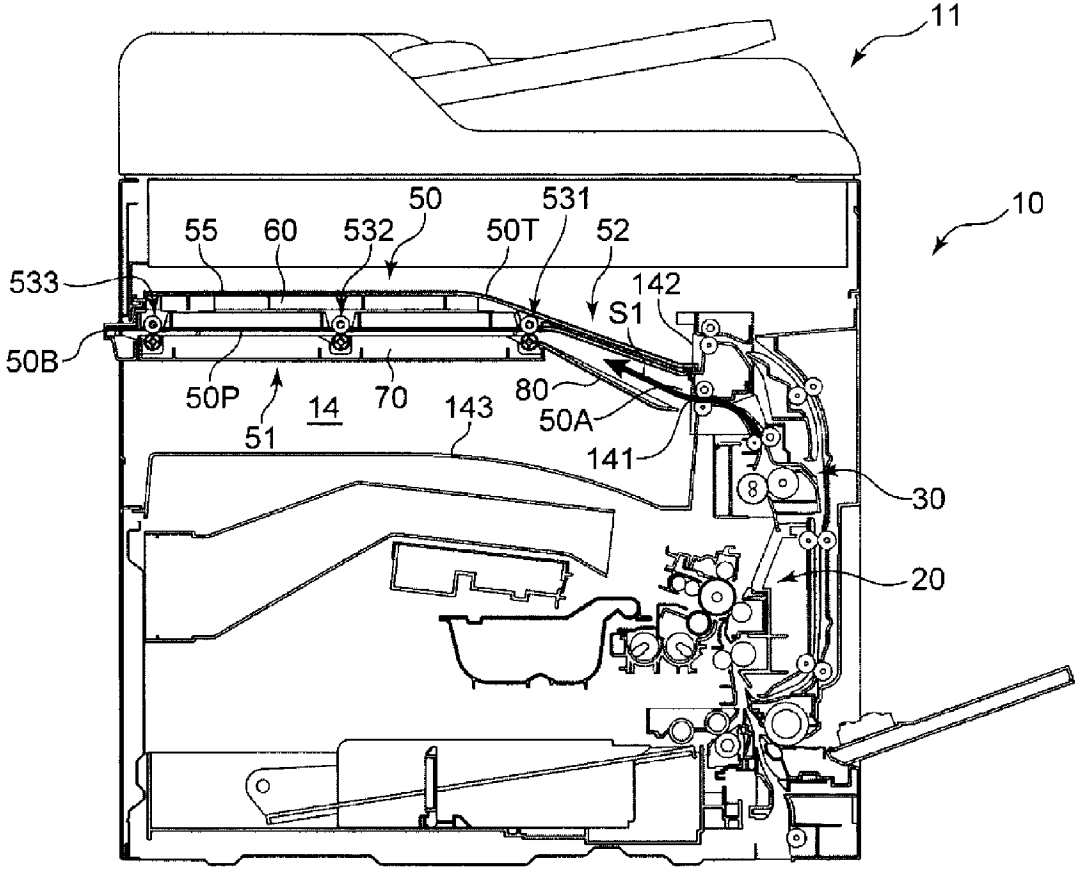
FIG. 4 is a cross sectional view showing an internal structure of the image forming apparatus with the relay unit fitted in one embodiment of the present disclosure and shows a state in which a sheet conveyance path is a path via the relay unit.
Figure 5:
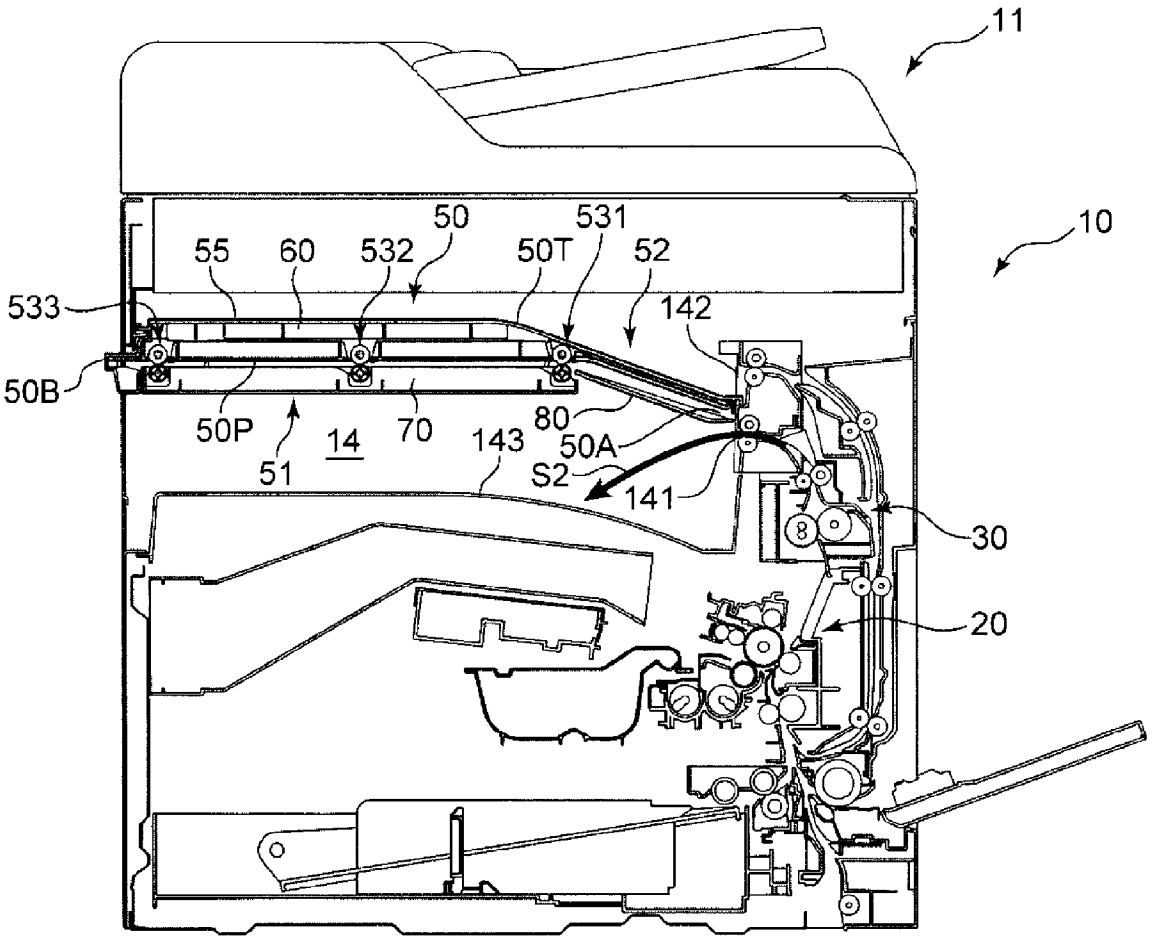
FIG. 5 is a cross sectional view showing an internal structure of the image forming apparatus with the relay unit fitted in one embodiment of the present disclosure and shows a state in which the sheet conveyance path is a path toward an in-body discharge tray.

FIGS. 4 and 5 are cross sectional views showing an internal structure of the apparatus body 1 with the relay unit 50 fitted thereto. FIG. 4 shows a state in which the sheet conveyance path (conveyance path for a sheet) is set as a path continuing to the post processing device 40 via the relay unit 50 (first path; see the arrow 51 in FIG. 4). FIG. 5 shows a state in which the sheet conveyance path is set as a path continuing to the in-body discharge tray 143 (second path; see the arrow S2 in FIG. 5).

The relay unit 50 generally includes two guide members layered in the vertical direction, that is, an upper guide member 60 and a lower guide member 70. It is noted that the relay unit 50 includes a main body 51 and an introduction section 52 as will be described later (see FIGS. 6 and 7). The main body 51 includes part of the upper guide member 60 and the lower guide member 70. The introduction section 52 includes the other part of the upper guide member 60. In other words, the upper guide member 60 forms the upper portion of the main body 51 and includes the introduction section 52. The lower guide member 70 forms the lower portion of the main body 51 and is arranged facing the upper guide member 60.

A relay conveyance path 50P which a sheet passes is formed in the relay unit 50. Specifically, the relay conveyance path 50P (sheet conveyance path) extending in the horizontal direction is formed between the upper guide member 60 and the lower guide member 70. The upper surface of the upper guide member 60 is covered with a cover member 55. The upper surface of the cover member 55 (upper surface of the relay unit 50) functions as a receiving tray 50T (placement tray). The receiving tray 50T receives a sheet of which part is discharged from the second exit port 142 for switchback.

An upper guide surface and a lower guide surface of the relay conveyance path 50P define the relay conveyance path 50P. The upper guide member 60 forms the upper guide surface of the relay conveyance path 50P. The upper guide surface corresponds to the lower surface of the upper guide member 60. The lower guide member 70 forms the lower guide surface of the relay conveyance path 50P. The lower guide surface corresponds to the upper surface of the lower guide member 70. The lower guide surface faces an area of the upper guide surface, which is included in the main body section 51, at a distance (for example, predetermined distance).

An upstream end 50A of the relay conveyance path 50P substantially faces the first exit port 141. A downstream end 50B of the relay conveyance path 50P faces the reception port 42 of the post processing device 40. Three pairs of conveyance rollers, that is, a pair of first conveyance rollers 531, a pair of second conveyance rollers 532, and a pair of third conveyance rollers 533, are provided in the relay conveyance path 50P at substantially regular intervals in the sheet conveyance direction. The relay unit 50 receives a sheet from the first exit port 141 and conveys the sheet to the reception port 42 of the post processing device 40 via the relay conveyance path 50P.

The relay unit 50 includes the main body 51 and the introduction section 52. The introduction section 52 is arranged upstream of the main body 51 in the sheet conveyance direction and forms an upstream portion of the relay conveyance path 50P (i.e., upstream end 50A and its vicinity). In other words, the main body 51 is arranged downstream of the introduction section 52 in the sheet conveyance direction to form a downstream portion of the relay conveyance path 50P.

The relay conveyance path 50P extends in the horizontal direction in the main body 51. By contrast, the relay conveyance path 50P is inclined downward as it goes right in the introduction section 52.

The guide plate 80 is mounted in the introduction section 52. The guide plate 80 is swingable in the vertical direction about its left end as a rotational pivot (turning pivot). The guide plate 80 switches the conveyance path for a sheet discharged from the first exit port 141 between the first path and the second path. The first path is a path in which a sheet passes via the relay unit 50. The second path is a path other than the first path. In the present embodiment, the second path is a path in which a sheet moves toward the in-body discharge tray 143. That is, the second path is a path in which a sheet is discharged onto the in-body discharge tray 143 from the first exit port 141 via the lower region of the in-body space.

The state shown in FIG. 4 is a state in which the guide plate 80 takes a posture of downward swinging (first posture) to open the upstream end 50A. Accordingly, in this state, as shown by the arrow S1, a sheet is received into the relay unit 50 (into the relay conveyance path 50P). By contrast, the state shown in FIG. 5 is a state in which the guide plate 80 takes a posture of upward swinging (second posture) to close the upstream end 50A. Accordingly, in this state, as shown by the arrow S2, a sheet is not received into the relay unit 50 and moves toward the in-body discharge tray 143.

In the present embodiment, a drive motor 65 (drive device; see FIG. 8 and others) changes the posture of the guide plate 80 between the first posture corresponding to the first path and the second posture corresponding to the second path. That is, drive force of the drive motor 65 for driving and rotating the pair of first conveyance rollers 531 changes the posture of the guide plate 80. Thus, this can eliminate to arrange a dedicated drive source for posture change of the guide plate 80. Hereinafter, a configuration of the relay unit 50 will be described further in detail.

Figure 6:
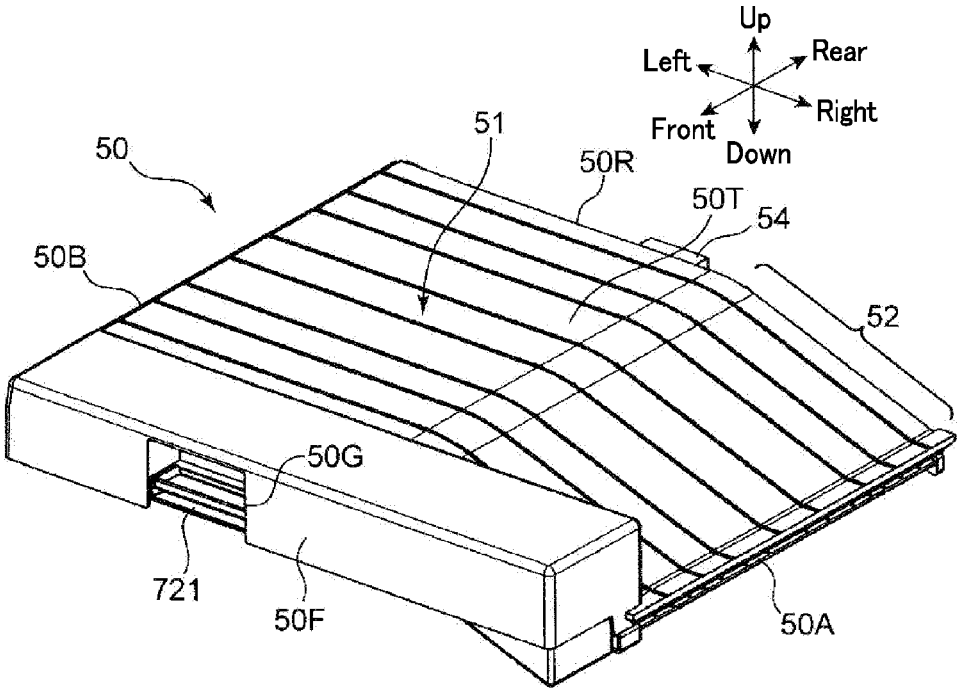
FIG. 6 is a perspective view of the relay unit in one embodiment of the present disclosure.
Figure 7:
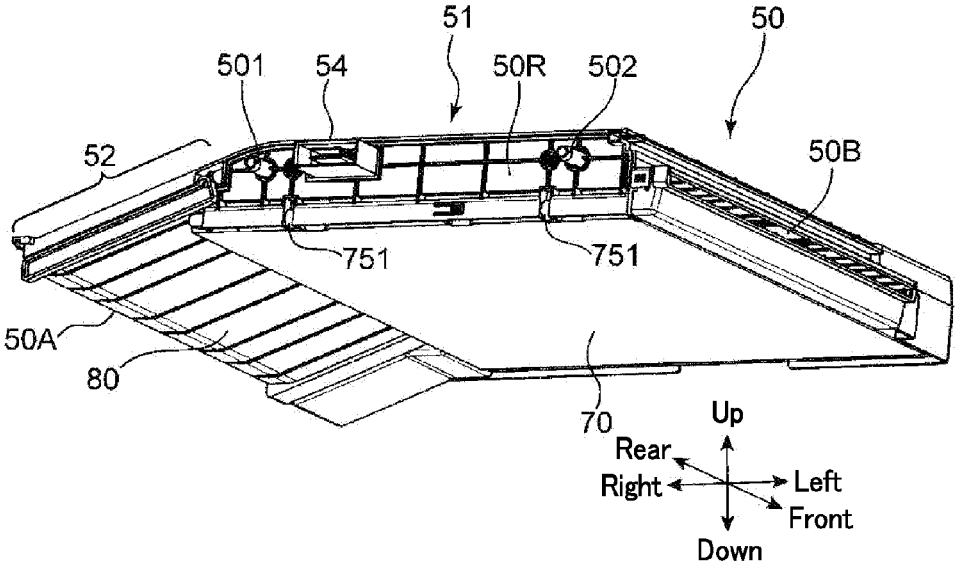
FIG. 7 is a perspective view of the relay unit viewed in a different direction from that in FIG. 6 in one embodiment of the present disclosure.

FIG. 6 is a perspective view of the relay unit 50. FIG. 7 is a perspective view of the relay unit 50 viewed in a different direction from that in FIG. 6. The relay unit 50 is a housing which has a substantially rectangular shape long in the transverse direction in a top view with a predetermined thickness in the vertical direction. Specifically, the relay unit 50 includes the main body 51 and the introduction section 52. The main body 51 has a substantially square shape in a top view and has a substantially rectangular parallelepiped shape as a whole. The introduction section 52 is located on the right part of the main body 51 and inclined downward to the right. The right end part of the relay unit 50 is the upstream end 50A from which a sheet is received. The left end part of the relay unit 50 is the downstream end 50A from which a sheet is discharged.

A front cover 50F serving also as a decorative cover is provided at the front edge of the relay unit 50. The front cover 50F has a rectangular parallelepiped shape long in the transverse direction. The front cover 50F extends across the entirety of the relay unit 50 in the transverse direction. The top surface of the front cover 50F is higher than the receiving tray 50T on the upper surface of the main body 51. Accordingly, the receiving tray 50T is covered with the front cover 50F and is not exposed in a front view.

A grip 50G is formed in the front part of the front cover 50F. Part of the front surface of the front cover 50F is cut out in rectangle to form the grip 50G. A user may hold and attach/detach the grip 50G to/from the in-body discharge section 14 of the relay unit 50. Further, a lever 721, which will be described later, for opening the relay conveyance path 50P is exposed in the grip 50G.

A pair of a position determination pin 501 and a position determination pin 502 is projected from a rear plate 50R of the relay unit 50. The pair of the position determination pin 501 and the position determination pin 502 is a positioning member in fitting the relay unit 50 to the in-body discharge section 14. A pair of pin holes (not shown) for receiving the pair of the position determination pin 501 and the position determination pin 502 is formed in the back plate of the apparatus body 1 which defines the back surface of the in-body space of the in-body discharge section 14. Further, a drawer connector 54 is projected from the rear plate 50R. A connector (not shown) connected with the drawer connector 54 is provided on the back plate of the apparatus body 1. Electrical wires for power supply or communications to the drive motor 65 and a sheet sensor, which will be described later, are electrically connected to a power supply section or a controller of the apparatus body 1 through the drawer connector 54.

Figure 8:
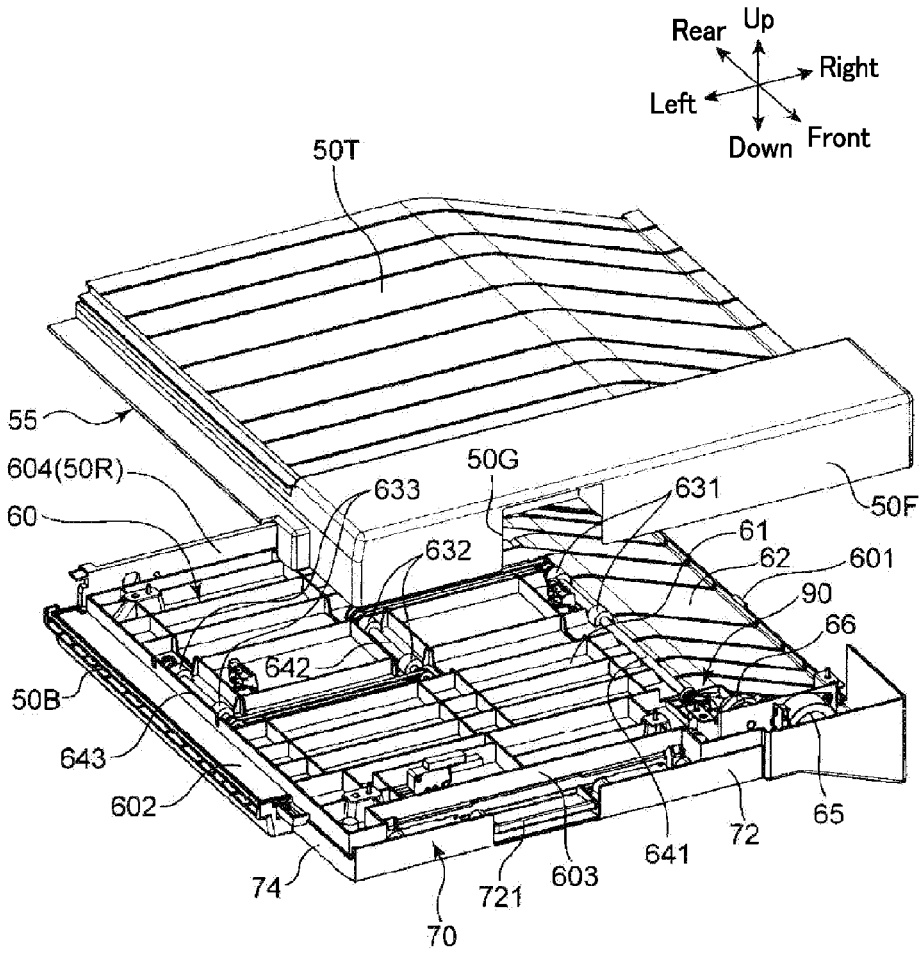
FIG. 8 is an exploded perspective view of the relay unit in one embodiment of the present disclosure.
Figure 9:
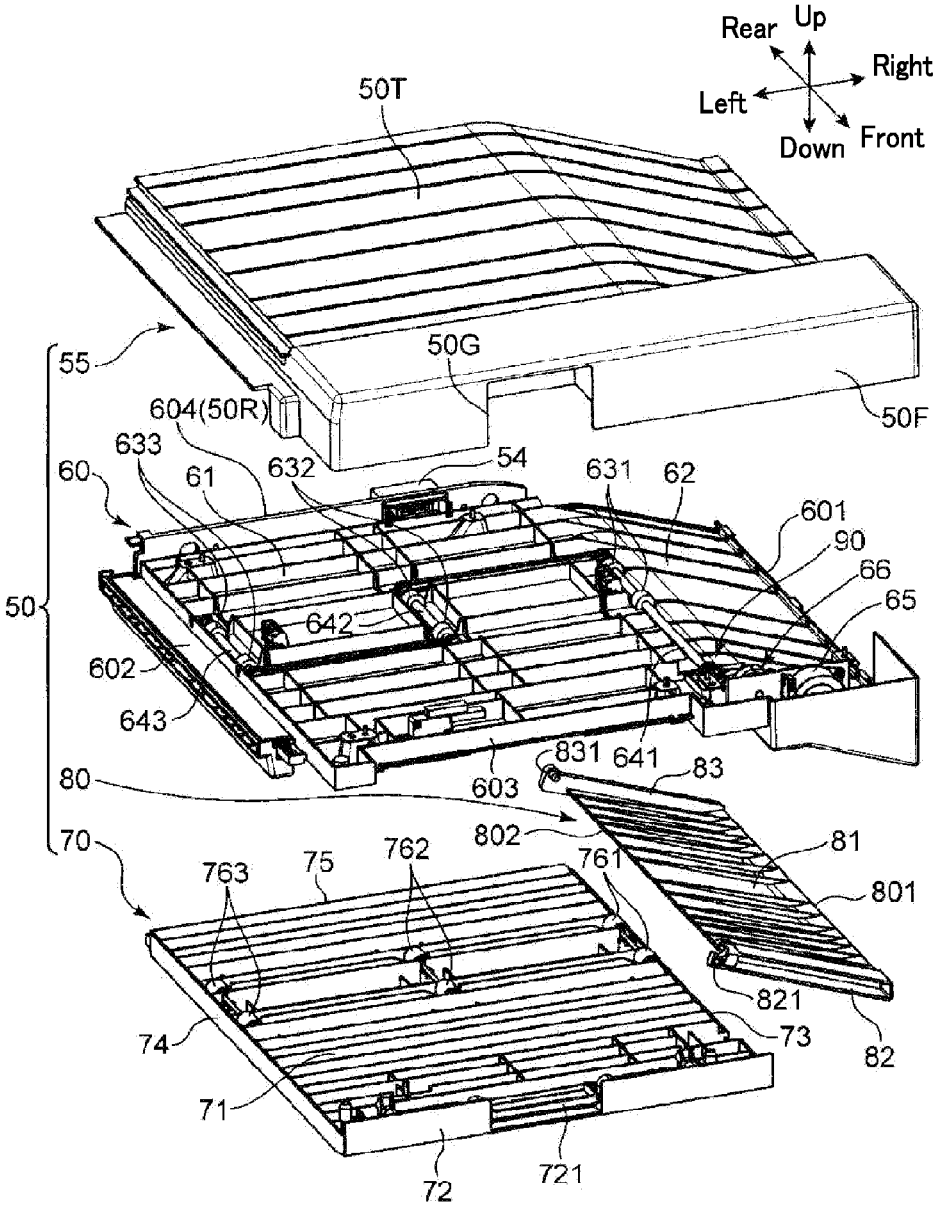
FIG. 9 is an exploded perspective view of the relay unit in one embodiment of the present disclosure.

FIG. 8 is an exploded perspective view of the relay unit 50. FIG. 9 is an exploded perspective view of the relay unit 50 which is further exploded than the state in FIG. 8. The relay unit 50 includes the upper guide member 60, the lower guide member 70, the guide plate 80, and the cover member 55. As described above, the upper guide member 60 and the lower guide member 70 are layered in the vertical direction to form the relay conveyance path 50P. The guide plate 80 forms an upstream portion of the relay conveyance path 50P and switches the sheet conveyance path between the first path and the second path. The cover member 55 is a member for covering a layered body of the upper guide member 60 and the lower guide member 70.

The upper guide member 60 includes a horizontal upper guide 61 and an inclined upper guide 62. The horizontal upper guide 61 has a substantially square shape corresponding to the main body 51 in a top view. The inclined upper guide 62 continues from the right end of the horizontal upper guide 61. The horizontal upper guide 61 is a combination body of a horizontal base plate, a plurality of transverse ribs extending in the transverse direction, and a plurality of back and forth ribs extending in the back and forth directions. The inclined upper guide 62 includes an inclined plate and a plurality of ribs. The inclined plate is continuous to the base member of the horizontal upper guide 61 and inclined downward to the right. The plurality of ribs project from the inclined plate.

Although the upper surface of the upper guide member 60 is exposed in FIGS. 8 and 9, the upper guide surface which defines the upper part of the relay conveyance path 50P is formed of the lower end of the rib members on the back surface of the upper guide member 60. A right edge 601 of the inclined upper guide 62 defines the upper part of the upstream end 50A of the relay unit 50. An outlet portion 602 which defines the downstream end 50B is provided at the left edge of the horizontal upper guide 61. A front plate 603 is provided at the front edge of the horizontal upper guide 61. A rear plate 604 is provided at the rear edge of the horizontal upper guide 61. The rear plate 604 is a member for forming the rear plate 50R of the relay unit 50. The drawer connector 54 is mounted on the rear plate 604.

Figure 10:
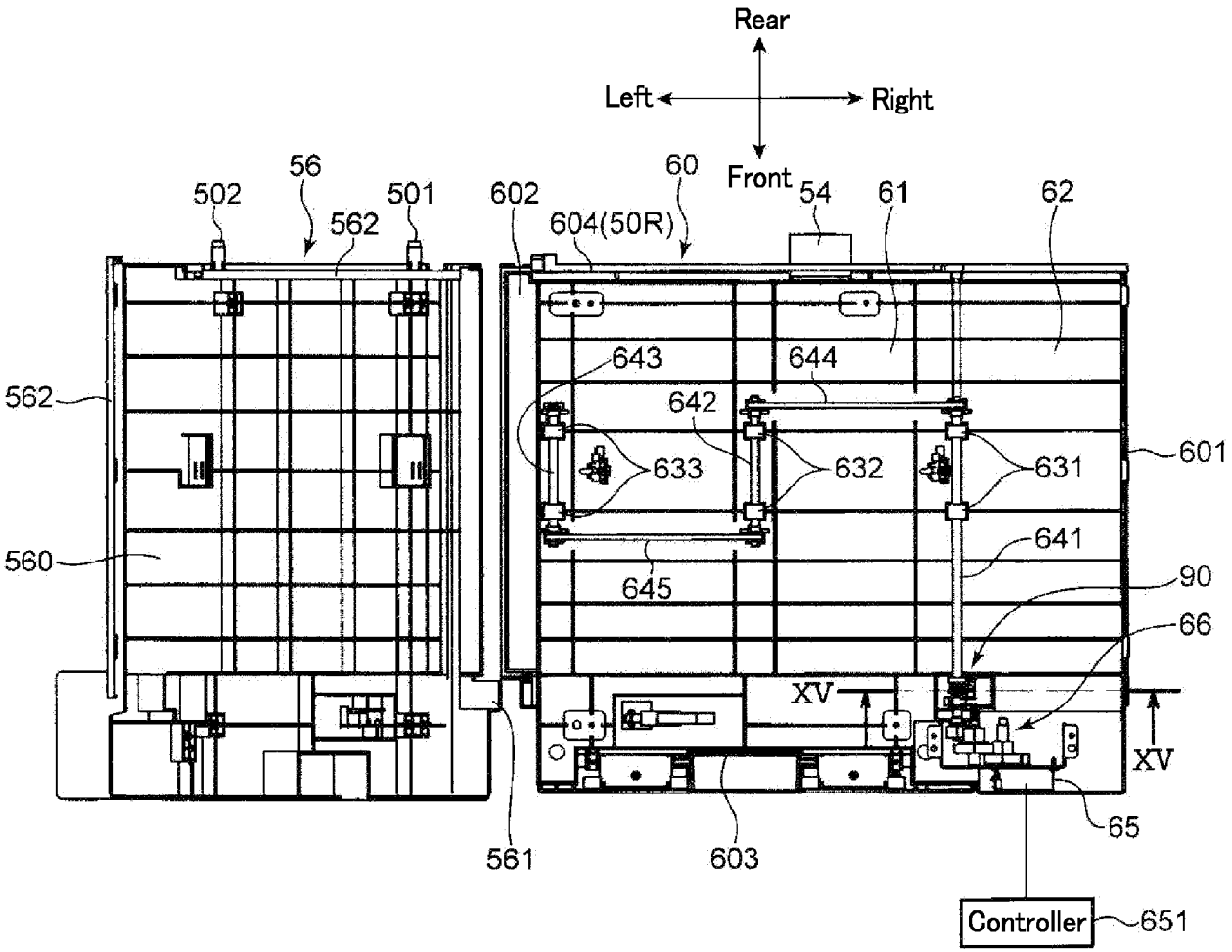
FIG. 10 is a top view of the relay unit with a cover member removed in one embodiment of the present disclosure.

FIG. 10 is a plan view of the upper guide member 60 viewed from above. In FIG. 10, an inner cover member 56, which is not exposed in FIGS. 8 and 9, is shown opened at 180 degrees on the left side of the upper guide member 60. The inner cover member 56 covers a region immediately above the horizontal upper guide 61. The upper guide member 60 includes a first conveyance roller 631 (conveyance roller), a second conveyance roller 632, and a third conveyance roller 633. The first conveyance roller 631, the second conveyance roller 632, and the third conveyance roller 633 convey a sheet in the relay conveyance path 50. The first conveyance roller 631, the second conveyance roller 632, and the third conveyance roller 633 correspond to respective ones of the pair of first conveyance rollers 531, the pair of second conveyance rollers 532, and the pair of third conveyance rollers 533, respectively.

The first conveyance roller 631, the second conveyance roller 632, and the third conveyance roller 633 are attached to the first shaft 641, the second shaft 642, and the third shaft 643, respectively, in an integrated manner. The first shaft 641, the second shaft 642, and the third shaft 643, serve as an rotational axis of the first conveyance roller 631, the rotational axis of the second conveyance roller 632, and the rotational axis of the third conveyance roller 633, respectively. Each of the first shaft 641 to the third shaft 643 extends in the back and forth directions.

The main body 51 supports the first shaft 641. Specifically, the first shaft 641 is arranged in the vicinity of the right end of the horizontal upper guide 61. The first shaft 641 is a comparatively long shaft and extends to the vicinity of the rear portion of the horizontal upper guide 61 from the vicinity of the front plate 603. It is noted that the inclined upper guide 62 (introduction section 52) is arranged on the right side of the first shaft 641 (upstream in the sheet conveyance direction). That is, the introduction section 52 is arranged upstream of the first shaft 641 in the sheet conveyance direction to form the upstream portion of the relay conveyance path 50P.

The second shaft 642 is a short shaft arranged in the middle of the horizontal upper guide 61 in the transverse direction and the back and forth directions. The third shaft 643 is a short shaft arranged in the vicinity of the left side of the horizontal upper guide 61 in the middle in the back and forth directions.

The drive motor 65 (drive device) is mounted at the right front end part of the upper guide member 60. The drive motor 65 rotates the first shaft 641. The drive motor 65 is a stepping motor in the present embodiment. A controller 651 included in the apparatus body 1 controls the rotation, stop, and rotational direction of the drive motor 65. A power transmission mechanism 66 including a plurality of gears is joined to the output shaft of the drive motor 65. Rotational force generated at the output shaft of the drive motor 65 is transmitted to the first shaft 641 through the power transmission mechanism 66. Thus, the first conveyance roller 631 rotates. That is, the drive motor 65 rotates the first shaft 641 to rotate the first conveyance roller 631.

The second conveyance roller 632 and the third conveyance roller 633 are also rotated by the rotational force of the drive motor 65. In other words, the rotational force of the first shaft 641 is transmitted to the second shaft 642 through a first belt 644. Further, the rotational force of the second shaft 642 is transmitted to the third shaft 643 through a second belt 645. Accordingly, when the controller 651 allows the drive motor 65 to drive, all of the first conveyance roller 631, the second conveyance roller 632, and the third conveyance roller 633 rotate in synchronization.

The inner cover member 56 includes a cover body 560 and a hinge 561. The cover body 560 has almost the same size as the horizontal upper guide 61. The hinge 561 hinge-joins the inner cover member 56 turnably with the upper guide member 60. In FIG. 10, the inner surface of the inner cover member 56 is exposed. In an assembled state, the inner cover member 56 coves the upper surface of the horizontal upper guide 61 with it turned about the axis of the hinge 561 by 180 degrees. A supporting plate 562 of the position determination pin 501 and the position determination pin 502 stands at the rear edge of the cover body 560.

Referring back to FIG. 9, the lower guide member 70 is substantially made up of a horizontal lower guide 71 corresponding to the main body 51 (i.e., horizontal upper guide 61 of the upper guide member 60) and is a member of which a region corresponding to the introduction section 52 (inclined upper guide 62) is missing. The horizontal lower guide 71 includes a plurality of rib members extending in the transverse direction. The upper surface of the lower guide member 70, which is exposed in FIG. 9, is a lower guide surface which defines the lower surface of the relay conveyance path 50P. The lower guide surface is formed of the upper edges of the rib members of the horizontal lower guide 71.

A first follower roll 761, a second follower roll 762, and a third follower roll 763 are mounted at positions facing the first conveyance roller 631, the second conveyance roller 632, and the third conveyance roller 633, respectively, in the lower guide member 70. The first conveyance roller 631 and the first follower roll 761 form a conveyance nip. The second conveyance roller 632 and the second follower roll 762 form a conveyance nip. The third conveyance roller 633 and the third follower roll 763 form a conveyance nip. The pair of first conveyance rollers 531 is made up of the first conveyance roller 631 and the first follower roll 761. The pair of second conveyance rollers 532 is made up of the second conveyance roller 632 and the second follower roll 762. The pair of third conveyance rollers 533 is made up of the third conveyance roller 633 and the third follower roll 763.

The lower guide member 70 includes a front plate 72 at the front edge thereof, a right plate 73 at the right edge thereof, a left plate 74 at the left edge thereof, and a rear plate 75 at the rear edge thereof. Hinge joints 751 (joint members; see FIG. 7) are provided on the rear plate 75. The lower guide member 70 is joined turnably to the upper guide member 60 by the hinge joints 751. A cut out portion is formed at the center of the front plate 72 in the transverse direction. A lever 721 is arranged in the cut out portion. The lever 721 is operated to lock the lower guide member 70 to the upper guide member 60. Further, the lever 721 is operated to release the lock. A user operates the lever 721 to release the lock to turn the lower guide member 70 about the turning axis of the hinge joints 751, thereby opening the relay conveyance path 50P.

The cover member 55 is slightly larger than the upper guide member 60. The cover member 55 covers the upper surface of the upper guide member 60 so as to accommodate the upper guide member 60 therein. The above described front cover 50F is provided at the front edge of the cover member 55. The upper surface of the cover member 55 behind the front cover 50F serves as the receiving tray 50T.

The guide plate 80 includes an inclined lower guide 81 (guide main body). The inclined lower guide 81 is arranged upstream of the lower guide member 70 in the sheet conveyance direction to face the lower surface of the inclined upper guide 62 of the upper guide member 60. The inclined lower guide 81 has substantially the same size as the inclined upper guide 62.

In FIG. 9, the lower guide surface of the introduction section 52 corresponds to the upper surface (introduction guide surface) of the inclined lower guide 81. The upper guide surface of the introduction section 52 corresponds to the lower surface of the inclined upper guide 62 (introduction guide surface). The upper surface of the inclined lower guide 81 and the lower surface of the inclined upper guide 62, which faces the upper surface at a predetermined distance, form the relay conveyance path 50P in the introduction section 52. In other words, the inclined lower guide 81 forms one of the pair of introduction guide surfaces which define the relay conveyance path 50P in the introduction section 52. The inclined upper guide 62 forms the other of the pair of introduction guide surfaces.

A front side plate 82 is provided at the front edge of the inclined lower guide 81. The front side plate 82 includes a first engagement portion 821 (engagement portion). The first shaft 641 is engaged rotatably with the first engagement portion 821. A rear side plate 83 is provided at the rear edge of the inclined lower guide 81. The rear side plate 83 includes a second engagement portion 831. The second engagement portion 831 is engaged rotatably with a pivot (not shown) provided in the rear plate 604 of the upper guide member 60. The first engagement portion 821 and the second engagement portion 831 are provided on the left side (downstream end) of the guide plate 80.

The guide plate 80 is rotatable about the first engagement portion 821 and the second engagement portion 831 as rotational pivots (turning pivots). Thus, an upstream end 801 is swingable in the vertical direction. When the upstream end 801 moves downward, a distance between the right edge 601 of the inclined upper guide 62 and the upstream end 801 increases. This opens the upstream end 50A wide (first posture). By contrast, when the upstream end 801 moves upward, a distance between the upstream end 801 and the right edge 601 is reduced to a small amount. This closes substantially the upstream end 50A (second posture). The guide plate 80 is mounted in the upper guide member 60 so as not to make a level difference between the downstream end 802 of the guide plate 80 and the lower guide surface defined by the horizontal lower guide 71 of the lower guide member 70.

Figure 11B:
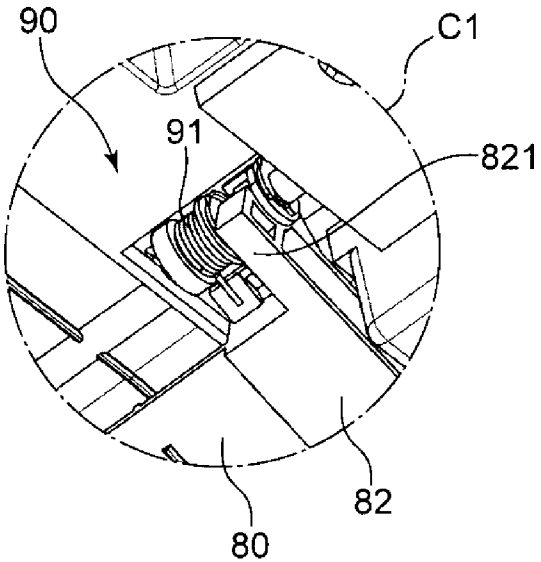
FIG. 11B is an enlarged view of a circle C1 in FIG. 11A (an operation mechanism for a guide plate).
Figure 11A:
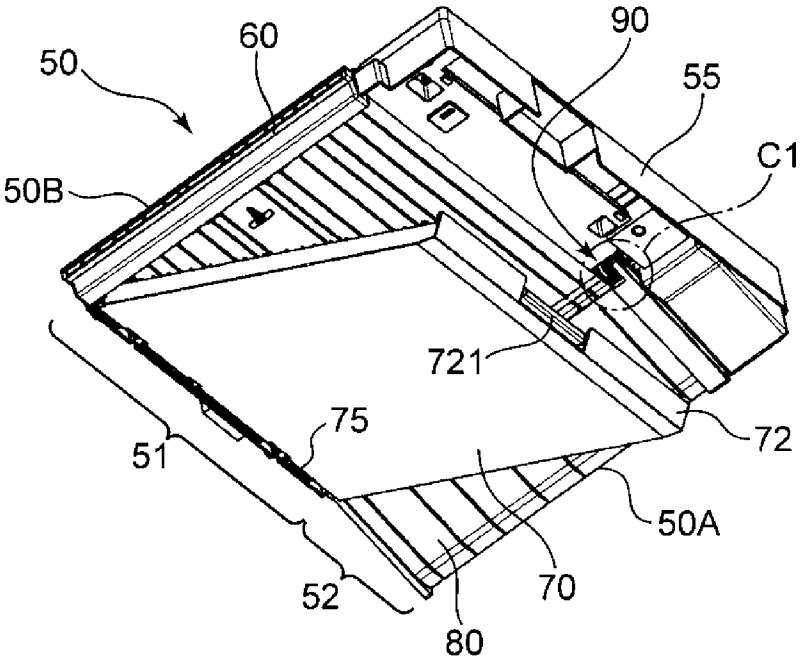
FIG. 11A is a perspective view of the relay unit with a lower guide member opened in one embodiment of the present disclosure.

FIG. 11A is a perspective view of the relay unit 50 with the lower guide member 70 open. FIG. 11B is an enlarged view of a circle C1 in FIG. 11A. The relay unit 50 includes an operation mechanism 90 to allow the guide plate 80 to perform the aforementioned swinging operation by utilizing drive force of the drive motor 65. The Circles C1 in FIGS. 11A and 11B show the operation mechanism 90. The operation mechanism 90 is arranged near the front end of the first shaft 641 in the vicinity of the first engagement portion 821. Hereinafter, a structure and an operation of the operation mechanism 90 will be described specifically.

Figure 12:
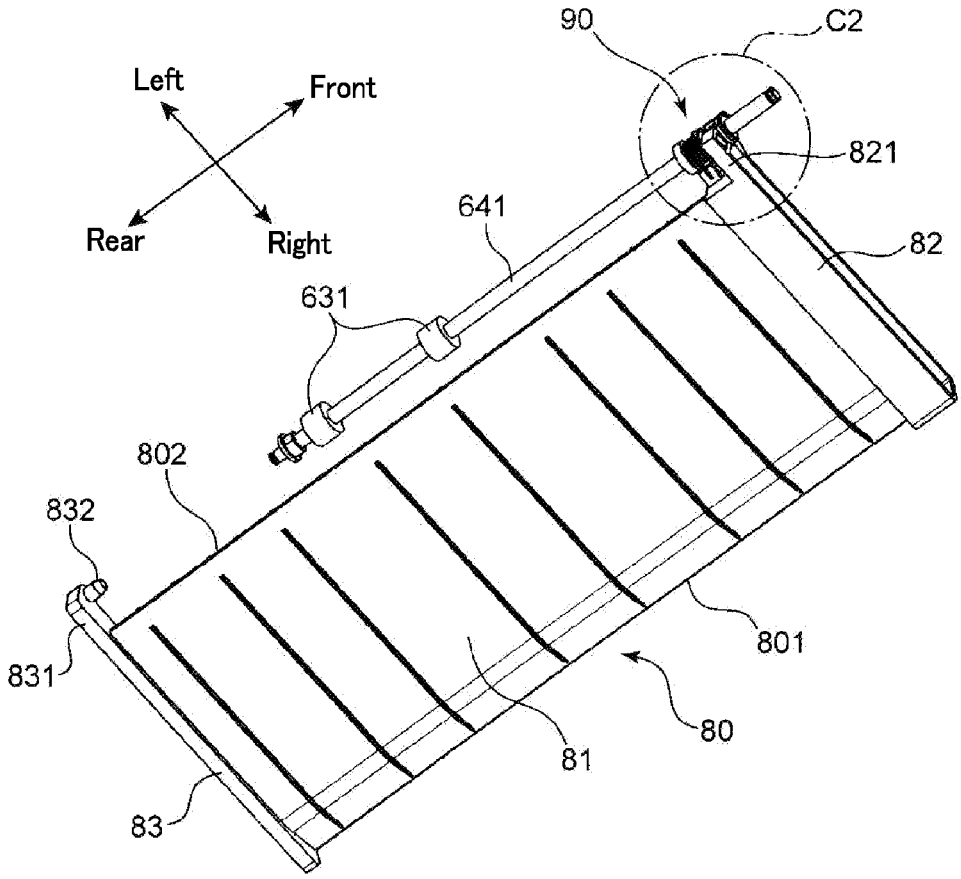
FIG. 12 is a perspective view of the guide plate in one embodiment of the present disclosure.
Figure 13:
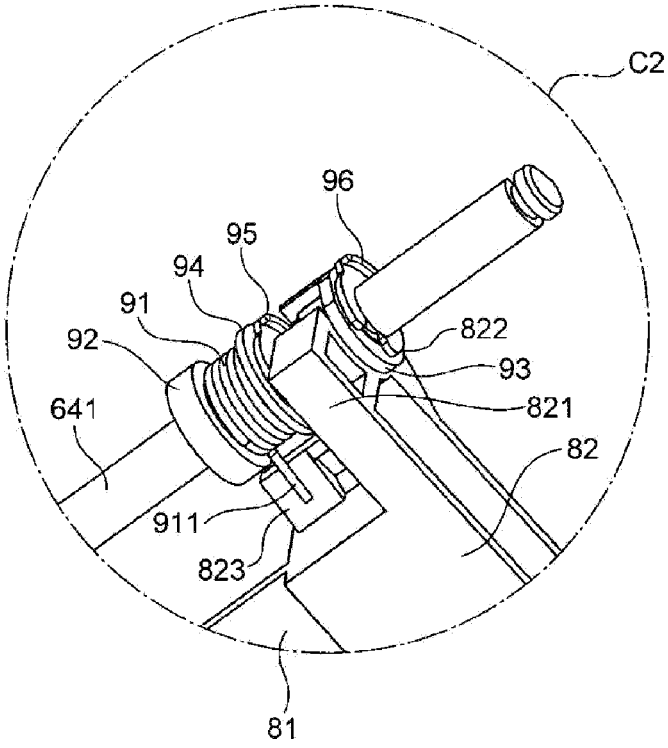
FIG. 13 is an enlarged view of a Circle C2 in FIG. 12 (an operation mechanism for the guide plate).
Figure 14:
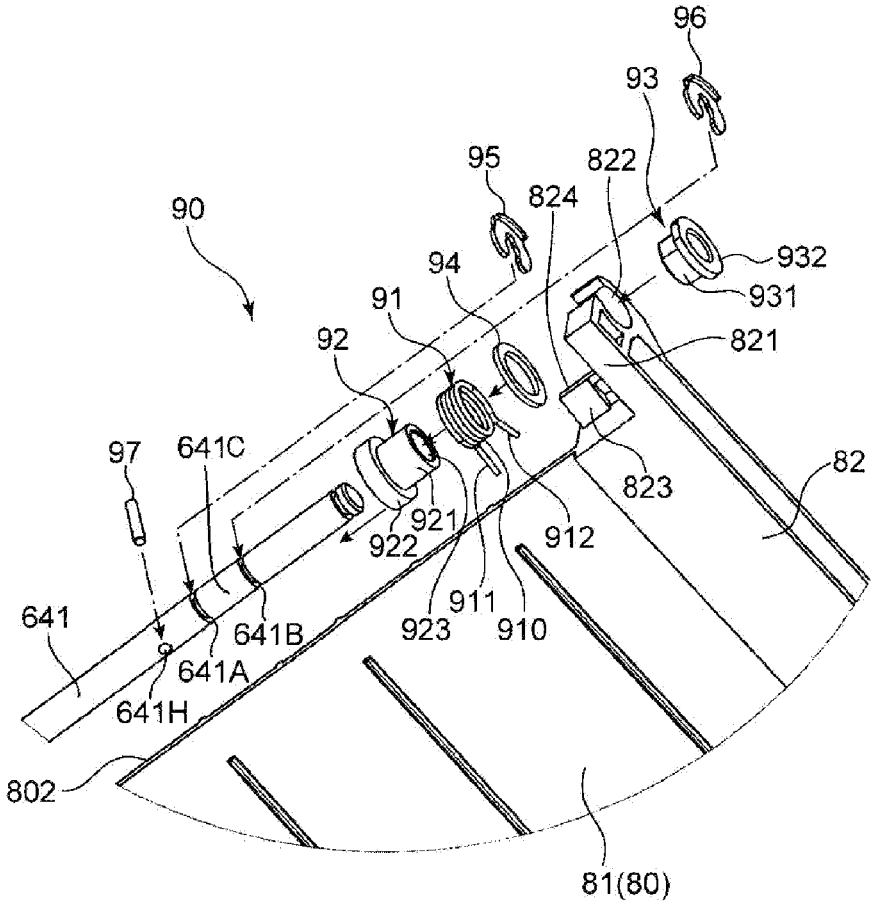
FIG. 14 is an exploded perspective view of the operation mechanism shown in FIG. 13.

FIG. 12 is a perspective view of the guide plate 80 and the operation mechanism 90. FIG. 13 is an enlarged view of the operation mechanism 90 circled by a Circle C2 in FIG. 12. FIG. 14 is an exploded perspective view of the operation mechanism 90 shown in FIG. 13. The operation mechanism 90 includes a torsion coil spring 91 (transmission member), a collar 92, a first pressure section 824, and a second pressure section 823 (also see FIGS. 15 and 17). The first pressure section 824 and the second pressure section 823 are arranged in the vicinity of the first engagement portion 821 of the guide plate 80. It is noted that the torsion coil spring 91 is one example of a transmission member for transmitting rotational force of the first shaft 641 to the guide plate 80.

The torsion coil spring 91 includes a coil 910, a first end portion 912, and a second end portion 911. The first end portion 912 extends from one end of the coil 910. The second end portion 911 extends from the other end of the coil 910.

The collar 92 is a cylindrical component. The collar 92 includes a small diameter portion 921, a large diameter portion 922, and a penetration hole 923. The small diameter portion 921 continues to the large diameter 922. The first shaft 641 is inserted in the penetration hole 923. The outer diameter of the small diameter portion 921 is slightly larger than the inner diameter of the coil 910 in a state in which the torsion coil spring 91 is unloaded. The outer diameter of the large diameter portion 622 is larger than the outer diameter of the coil 910.

The first shaft 641 is inserted in the collar 92. In a state in which the first shaft 641 is inserted in the collar 92, the collar 92 is fixed by a first stopper 95 and a pin 97 so as not to move in the axial direction of the first shaft 641 or move about the first shaft 641. The pin 97 is inserted in a penetration hole 641H penetrating the first shaft 641 in a direction orthogonal to the axial direction of the first shaft 641. The pin 97 is longer than the diameter of the first shaft 641. Accordingly, in a state in which the pin 97 is inserted in the penetration hole 641H, part of the pin 97 protrudes in the radial direction of the first shaft 641.

The collar 92 is inserted in the first shaft 641 with the torsion coil spring 91 fitted to the small diameter portion 921 of the collar 92. A groove extending in the radial direction is formed in the back surface of the large diameter portion 922 of the collar 92. When the collar 92 is inserted up to a predetermined point, the groove formed in the back surface of the large diameter portion 922 engages with the pin 97. Thus, rotation of the collar 92 about the first shaft 641 is restricted. In other words, the first shaft 641 and the collar 92 rotate integrally.

In the above described state, the first stopper 95 is fitted in a first annular groove 641A formed in the first shaft 641. Thus, movement of the collar 92 in the axial direction is restricted. A shim 94 is interposed between the front end surface of the small diameter portion 921 and the first stopper 95. The second end portion 911 of the torsion coil spring 91 abuts on the front surface of the large diameter portion 922, and the first end portion 912 of the torsion coil spring 91 abuts on the shim 94. This restricts movement of the torsion coil spring 91 in the axial direction. The torsion coil spring 91 rotates integrally with the collar 92 in an unloaded state. That is, when the first shaft 641 rotates about its axis, the torsion coil spring 91 also rotates about its axis. In other words, the coil 910 is inserted in the first shaft 641 to be integral with the first shaft 641, thereby making the coil 910 to be rotatable.

A second annular groove 641B is formed on the peripheral surface of the first shaft 641. The second annular groove 641B is formed at a distance from the first annular groove 641A. A region between the first annular groove 641A and the second annular groove 641B of the first shaft 641 corresponds to a supported portion 641C supported by a bearing 93. The bearing 93 is fitted up to the position of the supported portion 641C from the front end of the first shaft 641. In this state, a second stopper 96 is fitted to the second annular groove 641B. The bearing 93 includes a bearing main body 931 and a flange 932. The bearing main body 931 is fitted in an arch-shaped groove 822 formed in the first engagement portion 821 of the guide plate 80. The flange 932 abuts on the rim of the arch-shaped groove 822. Thus, the first shaft 641 is positioned relative to the first engagement portion 821.

The first engagement portion 821 of the front side plate 82 protrudes leftward of the downstream end 802 of the guide plate 80. Similarly, the second engagement portion 831 of the rear side plate 83 protrudes leftward of the downstream end 802 of the guide plate 80. Thus, a shallow U-shaped space is formed on the left end part of the guide plate 80. The first shaft 641 extends in parallel with the downstream end 802 in the U-shaped space. A pivot pin 832 is provided in the second engagement portion 831 to protrude frontward. The pivot pin 832 is supported by a pivot (not shown) provided on the rear plate 604 of the upper guide member 60. The pivot pin 832 and the first shaft 641 (arch-shaped groove 822) are coaxially arranged. The guide plate 80 rotates (turns) about the axis of the first shaft 641 (first engagement portion 821) and the pivot pin 832 (second engagement portion 831).

Figure 15:
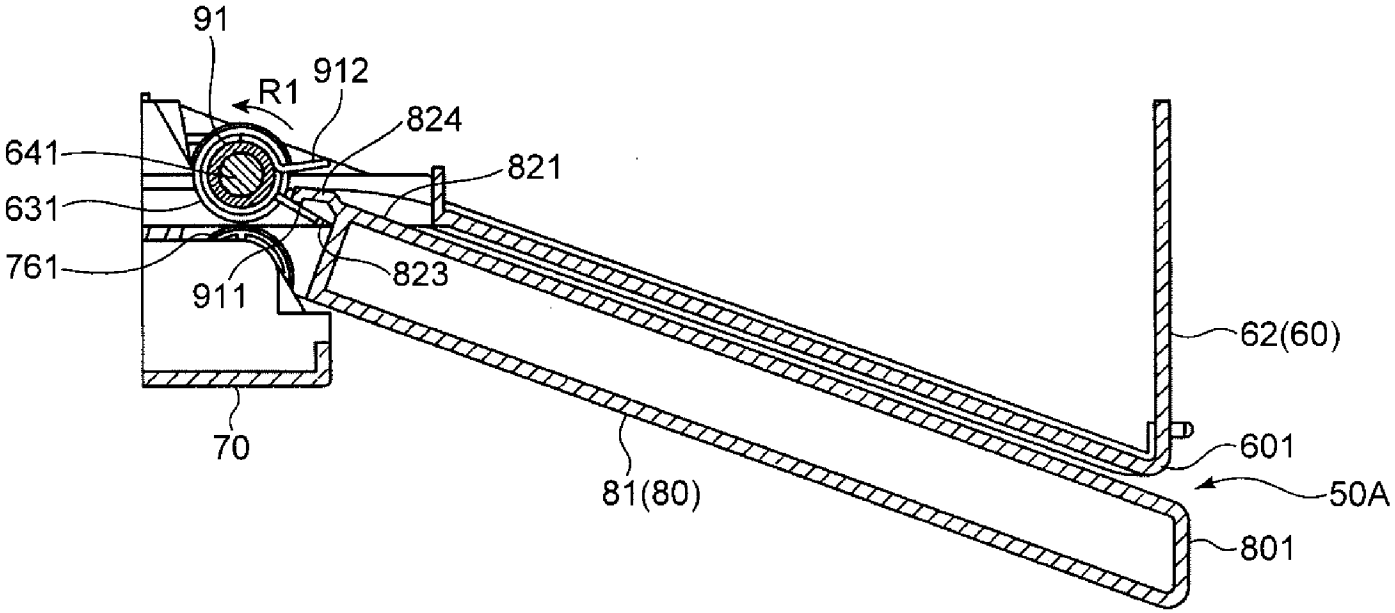
FIG. 15 is a cross sectional view taken along the line XV-XV of FIG. 10 and shows an operation of the guide plate (state of the second posture).
Figure 17:
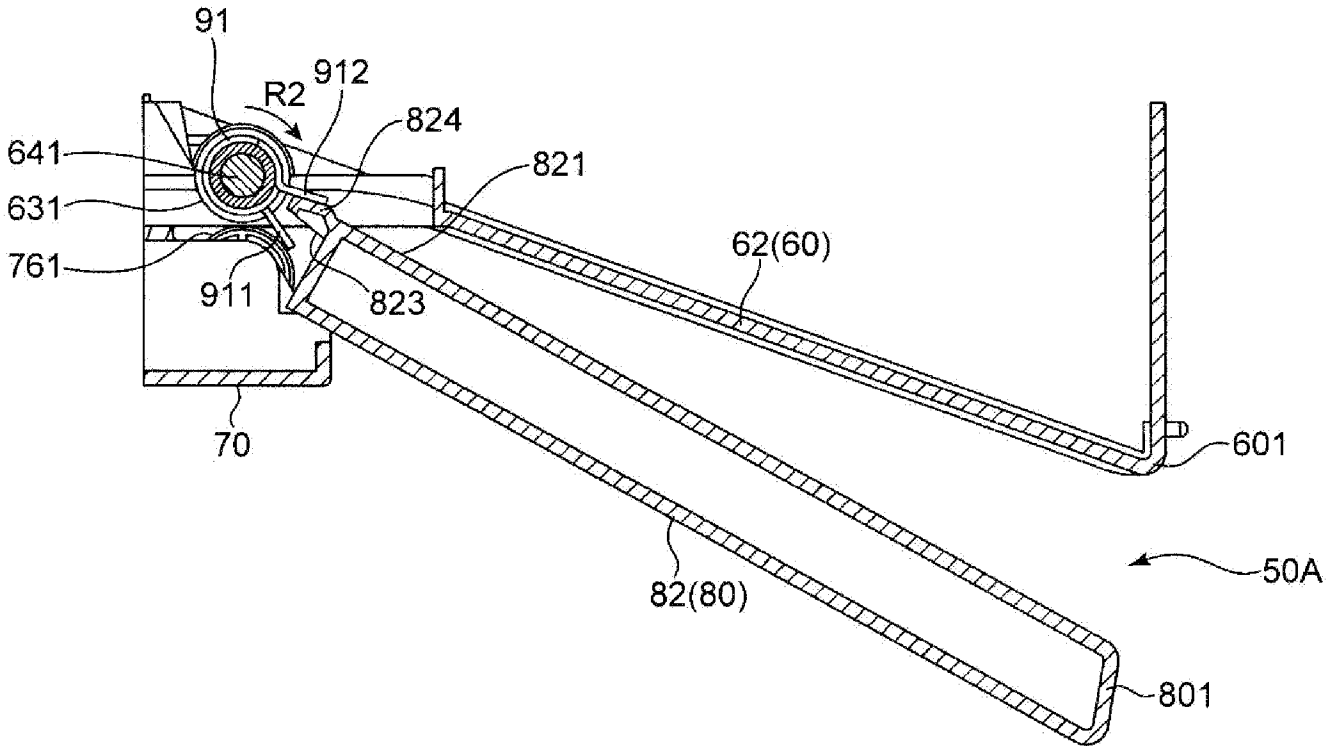
FIG. 17 is a cross sectional view showing an operation of the guide plate (state of the first posture) in one embodiment of the present disclosure.

The first pressure section 824 and the second pressure section 823 are arranged at the left end part of the front side plate 82 at the back of the first engagement portion 821. The first pressure section 824 and the second pressure section 823 are adjacent to the torsion coil spring 91 in the transverse direction. Referring also to FIGS. 15 and 17, the first pressure section 824 is a flat surface facing upward. The second pressure section 823 is a flat surface facing downward. The first pressure section 824 and the second pressure section 823 are substantially provided back to back.

The first pressure section 824 is a surface provided to correspond to the first end portion 912 of the torsion coil spring 91. When the torsion coil spring 91 rotates (turns) integrally with the first shaft 641 in the clockwise direction (first direction) indicated by the arrow R2 in FIG. 17, the first end portion 912 presses the first pressure section 824. In other words, the first pressure section 824 is pressed by the first end portion 912 in posture change of the guide plate 80 to the first posture by the rotation in the clockwise direction (first direction).

The second pressure section 823 is a surface provided to correspond to the second end portion 911 of the torsion coil spring 91. The second end portion 911 presses the second pressure section 823 when the torsion coil spring 91 rotates (turns) in the counterclockwise direction (second direction) indicated by the arrow R1 in FIG. 15. In other words, the second pressure section 823 is pressed by the second end portion 911 in posture change of the guide plate 80 to the second posture by the rotation in the counterclockwise direction (second direction).

Pressure by the second end portion 911 of the torsion coil spring 91 against the second pressure portion 823 allows the guide plate 80 to swing about the axis of the first shaft 641 such that the upstream end 801 moves upward. In other words, the drive motor 65 rotates the first shaft 641 in the second direction, which is reverse to the first direction, to change the posture of the guide plate 80 to the second posture to close the upstream end 50A of the relay conveyance path 50P. By contrast, pressure by the first end portion 912 against the first pressure portion 824 allows the guide plate 80 to swing such that the upstream end 801 moves downward. In other words, the drive motor 65 rotates the first shaft 641 in the first direction to change the posture of the guide plate 80 to the first posture to open the upstream end 50A of the relay conveyance path 50P.

A swinging range of the guide plate 80 is restricted by a first restricting portion 67 and a second restricting portion 621 provided in the upper guide member 60. Hereinafter, an operation of the guide plate 80, the first restricting portion 67, and the second restricting portion 621 will be described.

Figure 16A:
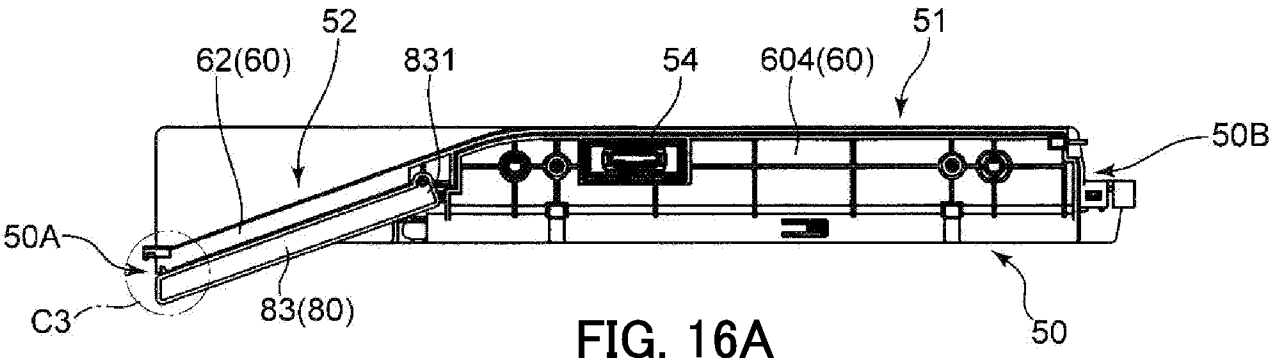
FIG. 16A is a back view of the relay unit in one embodiment of the present disclosure.
Figure 16B:
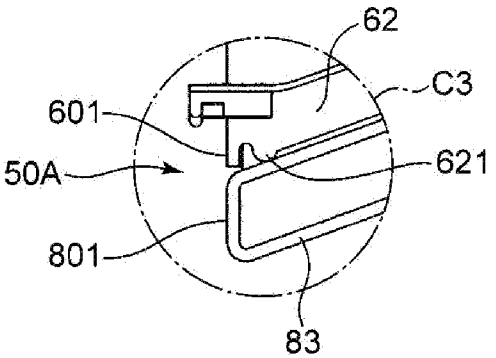
FIG. 16B is an enlarged view of a Circle C3 in FIG. 16A.

FIG. 15 is a cross sectional view for explaining the operation of the guide plate 80. FIG. 16A is a back view of the relay unit 50. FIG. 16B is an enlarged view of a Circle C3 in FIG. 16A. FIG. 15 shows a state in which the guide plate 80 takes the second posture of upward swinging to close the upstream end 50A so that the sheet conveyance path is switched to the second path continuing to the in-body discharge tray 143, as shown in FIG. 5.

In this case, the controller 651 controls the drive motor 65 to generate rotational force that makes the first shaft 641 rotate in the counterclockwise direction indicated by the arrow R1 (second direction). The rotational direction indicated by the arrow R1 is reverse to the rotational direction of the first shaft 641 in conveying a sheet into the relay unit 50. Rotation of the first shaft 641 also makes the torsion coil spring 91 rotate in the direction indicated by the arrow R1.

Accompanied by the rotation of the torsion coil spring 91, the second end portion 911 of the torsion coil spring 91 abuts on the second pressure section 823 to press the second pressure section 823. Accordingly, the guide plate 80 also rotates about the axis of the first shaft 641 in the direction indicated by the arrow R1. Thus, the upstream end 801 moves upward to be close to the right edge 601 of the inclined upper guide 62. In this state, the upstream end 50A is closed. Thus, the relay conveyance path 50P of the relay unit 50 is incapable of receiving a sheet discharged from the first exit port 141.

At that time, as shown in FIG. 16, part of the upper surface of the rear side plate 83 of the guide plate 80, which is close to the upstream end 801, abuts on the second restricting portion 621. This abutting restricts the rotation of the guide plate 80 in the direction indicated by the arrow R1. In other words, the second restricting portion 621 restricts the rotation of the guide plate 80 in the counterclockwise direction (second direction). The second restricting portion 621 is arranged around the right end on the back surface of the inclined upper guide 62.

By contrast, pressure by the second end portion 911 of the torsion coil spring 91 against the second pressure section 823 is exerted continuously. Thus, the coil 910 loosens to increase the inner diameter of the coil 910. In other words, the guide plate 80 abuts on the second restricting portion 621 to loosen the coil 910 to increase the inner diameter thereof. This releases the state of the torsion coil spring 91 rotating integrally with the first shaft 641 (collar 92). In other words, the first shaft 641 idles relative to the coil 910 so that the rotational force of the first shaft 641 is not transmitted to the guide plate 80. Thus, excessive torque is not applied to the drive motor 65.

The second restricting portion 621 shown as an example in the present embodiment is an arch-shaped protrusion protruding downward at the right edge 601 of the inclined upper guide 62, which is merely an example. The second restricting portion 621 may be any protrusion as long as the entire surface of the guide plate 80 can avoid collision with the inclined upper guide 62. Further, the protrusion may be provided on the side of the guide plate 80.

Figure 18A:
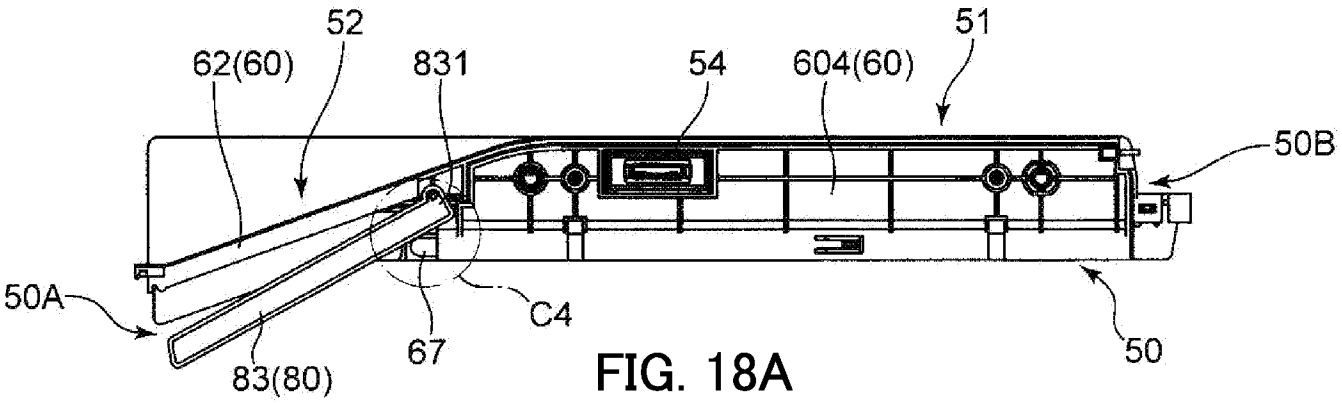
FIG. 18A is a back view of the relay unit in one embodiment of the present disclosure.
Figure 18B:
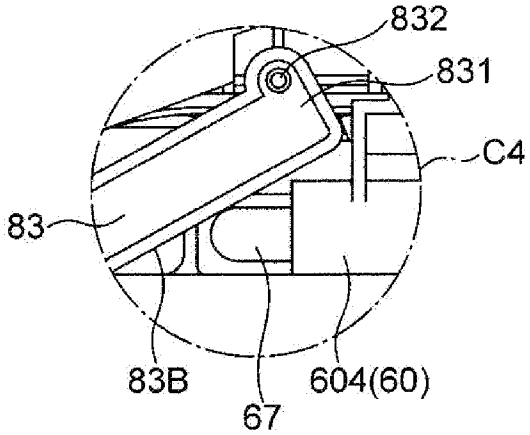
FIG. 18B is an enlarged view of a Circle C4 in FIG. 18A.

FIG. 17 is a cross sectional view for explaining an operation of the guide plate 80. FIG. 18A is a back view of the relay unit 50. FIG. 18B is an enlarged view of a Circle C4 in FIG. 18A. FIG. 17 shows a state in which the guide plate 80 takes the first posture of downward swinging to open the upstream end 50A so that the sheet conveyance path is switched to the first path passing via the relay unit 50, as shown in FIG. 4.

In this case, the controller 651 controls the drive motor 65 to generate rotational force that makes the first shaft 641 rotate in the clockwise direction indicated by the arrow R2 (first direction). The rotational direction indicated by the arrow R2 is a rotational direction in which the first conveyance roller 631 conveys a sheet to the downstream end 50B from the upstream end 50A of the relay conveyance path 50P. Specifically, the rotational direction indicated by the arrow R2 is a rotational direction of the first shaft 641 (first conveyance roller 631) in conveying a sheet to the downstream end 50B from the upstream end 50A in the relay conveyance path 50P of the relay unit 50.

The rotation of the first shaft 641 also rotates the torsion coil spring 91 in the direction indicated by the arrow R2. Accompanied by the rotation of the torsion coil spring 91, the first end portion 912 of the torsion coil spring 91 also abuts on the first pressure section 824 from the state shown in FIG. 15 to press the first pressure section 824. Accordingly, the guide plate 80 also rotates about the axis of the first shaft 641 in the direction indicated by the arrow R2. Thus, the upstream end 801 moves downward away from the right edge 601 of the inclined upper guide 62. In this state, the upstream end 50A is opened. Thus, the relay conveyance path 50P of the relay unit 50 is capable of receiving a sheet discharged from the first exit port 141.

At that time, as shown in FIG. 18, part of the lower surface of the rear side plate 83 of the guide plate 80, which is close to the downstream end 802, abuts on the first restricting portion 67. This abutting restricts the rotation of the guide plate 80 in the direction indicated by the arrow R2. In other words, the first restricting portion 67 restricts the rotation of the guide plate 80 in the clockwise direction (first direction). Thus, opening degree of the upstream end 50A can be restricted within an appropriate range. The first restricting portion 67 is arranged in the vicinity of the right end part of the rear plate 604 of the upper guide member 60 below the guide plate 80.

By contrast, pressure by the first end portion 912 of the torsion coil spring 91 against the first pressure section 824 continues. Thus, the coil 910 loosens to increase the inner diameter of the coil 910. In other words, the guide plate 80 abuts on the first restricting portion 67 to allow the coil 910 to loosen, thereby increasing the inner diameter thereof. This releases the state of the torsion coil spring 91 rotating integrally with the first shaft 641. In other words, the rotational force of the first shaft 641 is not transmitted to the guide plate 80.

The first restricting portion 67 shown as an example in the present embodiment is an arch-shaped protrusion protruding rightward from the vicinity of the right edge part of the rear plate 604, which is merely an example. The first restricting portion 67 may be any protrusion as long as it interferes with the back surface of the guide plate 80. Further, the protrusion may be provided on the side of the guide plate 80.

As describe above, the torsion coil spring 91 is a member having a function of transmitting the rotational force of the first shaft 641 to the guide plate 80. The torsion coil spring 91 transmits the rotational force of the first shaft 641 to the guide plate 80 in a range which the rotation of the guide plate 80 is not restricted by either the first restricting portion 67 and the second restricting portion 621. By contrast, the torsion coil spring 91 does not transmit the rotational force of the first shaft 641 to the guide plate 80 in a state in which the rotation of the guide plate 80 is restricted by the first restricting portion 67 and the second restricting portion 621.

As described above, transmission of the rotational force of the first shaft 641 to the guide plate 80 can be restricted by a simple structure in which the torsion coil spring 91 is inserted in the first shaft 641, thereby restricting a range of swinging accompanied by change in posture of the guide plate 80 within an appropriate range. The function of the aforementioned transmission member can be achieved with a simple member and structure in which the torsion coil spring 91 is inserted in the first shaft 641.

As described above, according to the present embodiment, in the image forming apparatus with the relay unit 50 for sheet conveyance mounted in an in-body space, switching of the sheet conveyance path by changing the posture of guide plate 80 can be achieved by utilizing the drive motor 65 included in the relay unit 50, without using a dedicated solenoid, dedicated drive motor, etc. Accordingly, increase in number of components and cost can be prevented.

Further, the rotation of the first shaft 641 serving as the rotational axis of the conveyance roller 631 changes the posture of the guide plate 80. Also, the posture of the guide plate 80 can be changed between the first posture and the second posture according to the rotation direction of the first shaft 641. Accordingly, the controller 651 merely controls rotational direction of the drive motor 65 included as standard in the relay unit 50 to switch the sheet conveyance path.

Next, other advantages of the present embodiment will be described. First, as shown in FIGS. 4 and 5, the body housing 10 includes the second exit port 142 for sheet exit, which is open toward the in-body space at a position higher than the first exit port 141. The relay unit 50 includes on its upper surface the receiving tray 50T for receiving at least part of a sheet discharged from the second exit port 142.

According to this configuration, a sheet discharged from the first exit port 141 can move toward the first path or the second path. In addition, a sheet can be guided to a different path also from the second exit port 142. Thus, various sheet conveyance paths can be used. Further, in the present embodiment, the upstream end of the reverse conveyance path P4 is directly connected to the second exit conveyance path P3 continuing to the second exit port 142. Accordingly, use of the receiving tray 50T as a switchback conveyance path for sheet can result in smooth processing in duplex printing.

Figure 19:
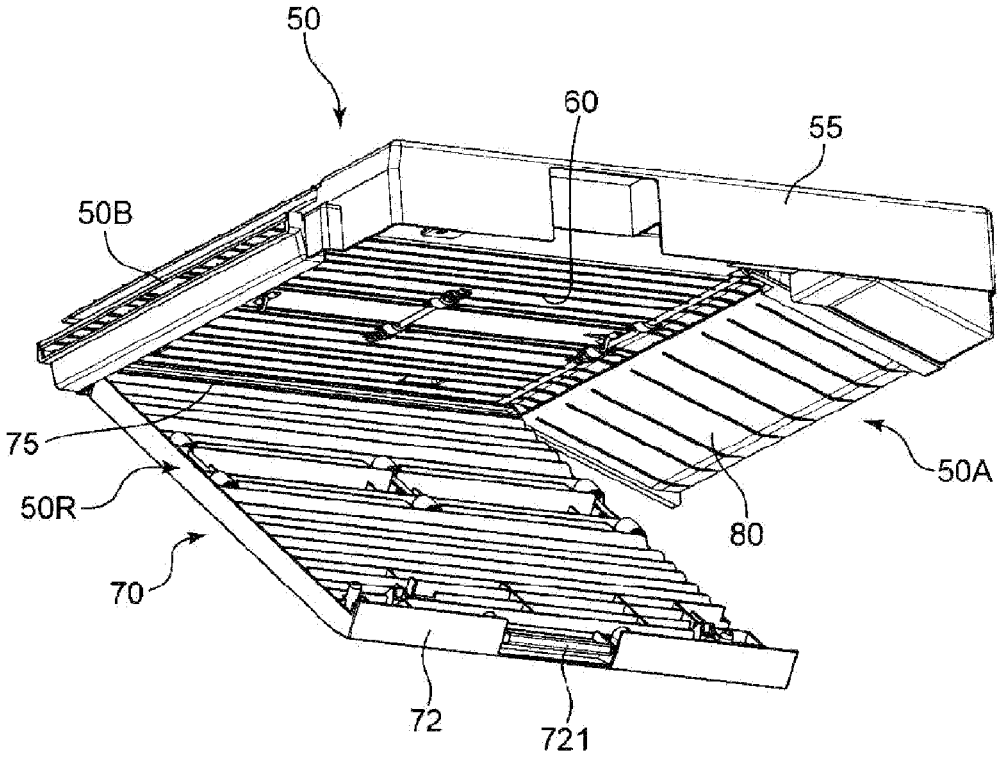
FIG. 19 is a perspective view of the relay unit with the lower guide member opened in one embodiment of the present disclosure.

Moreover, the lower guide member 70 is joined turnably to the upper guide member 60 by the hinge joints 751 (see FIG. 7) provided on the rear plate 75. Accordingly, as shown in FIG. 19, turning the lower guide member 70 about the turning axis of the hinge joints 751 opens the relay conveyance path 50P. As described above, the relay unit 50 is arranged in the upper region of the in-body space of the in-body discharge section 14. The lower region is open space for securing a paper exit path to the in-body discharge tray 143.

Figure 20:
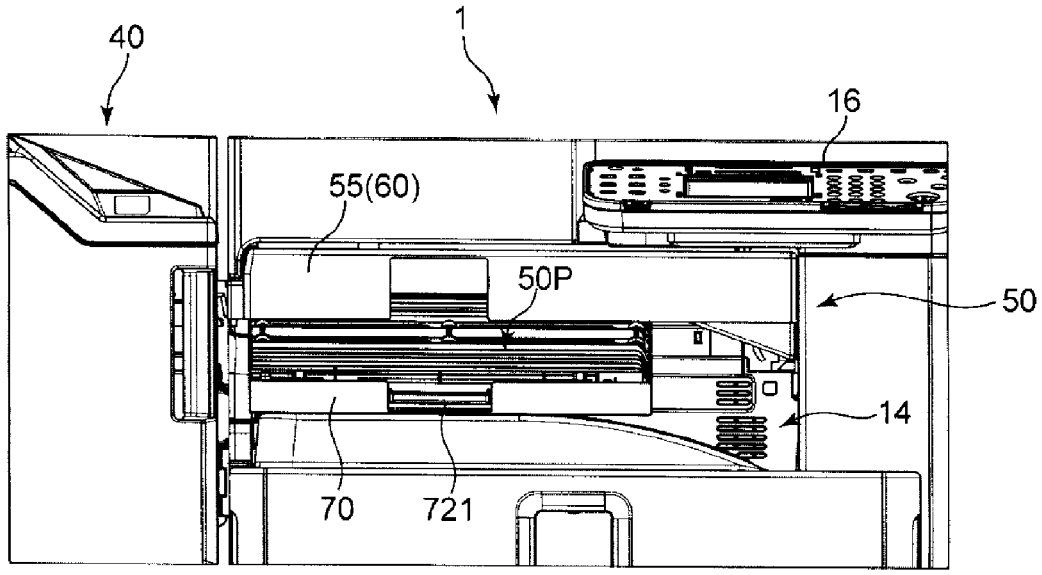
FIG. 20 is a front view showing a state in which the lower guide member of the relay unit is opened with the relay unit fitted in an in-body space in one embodiment of the present disclosure.
Figure 21:
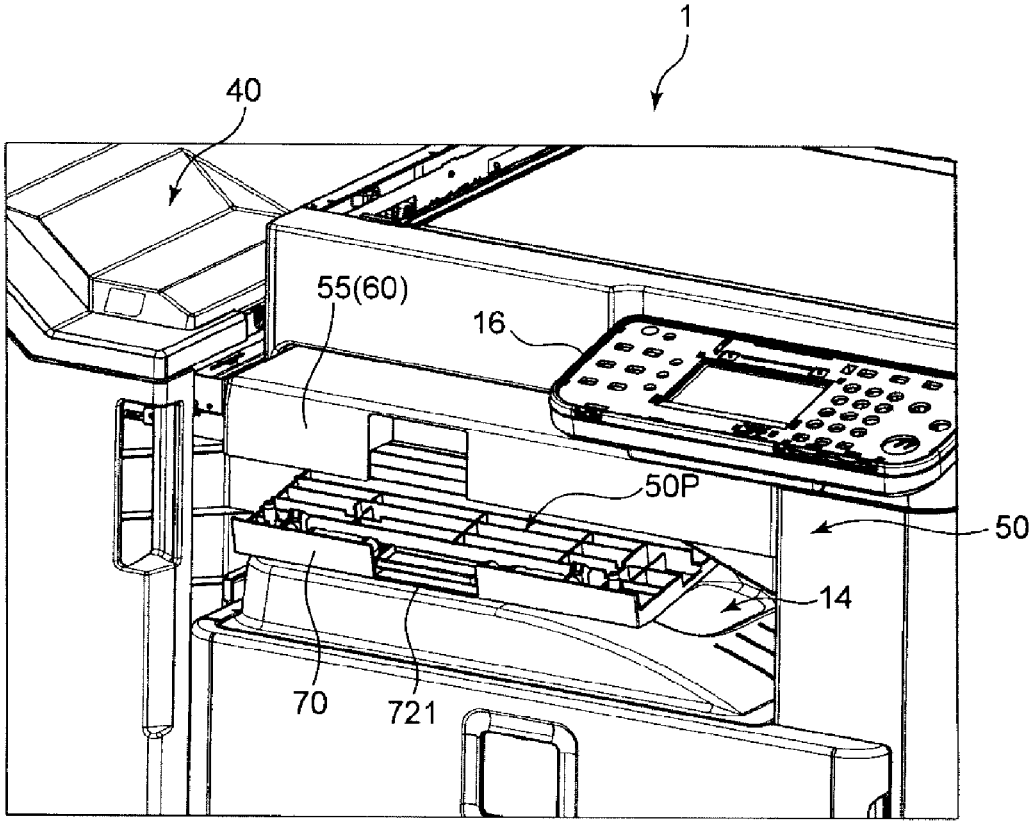
FIG. 21 is a perspective view of FIG. 20.

FIG. 20 is a front view showing a state in which the lower guide member 70 is open with the relay unit 50 fitted to the in-body space. FIG. 21 is a perspective view of FIG. 20. When a sheet jam occurs in the relay unit 50, a user operates the lever 721 to release the lock. Then, as shown in FIGS. 20 and 21, the user can open the relay conveyance path 50P by turning the lower guide member 70.

At that time, the first conveyance roller 631 and the first follower roll 761 are separated. The second conveyance roller 632 and the second follower roll 762 are separated. The third conveyance roller 633 and the third follower roll 763 are separated. Accordingly, the conveyance nips of the pair of first conveyance rollers 531, the pair of second conveyance rollers 532, and the pair of third conveyance rollers 533 are released. Thus, it is expected that a jammed sheet in the relay conveyance path 50P slides down onto the lower guide member 70 when the lower guide member 70 is opened. Thus, a user can easily perform a jam clearance operation.

Figure 22:
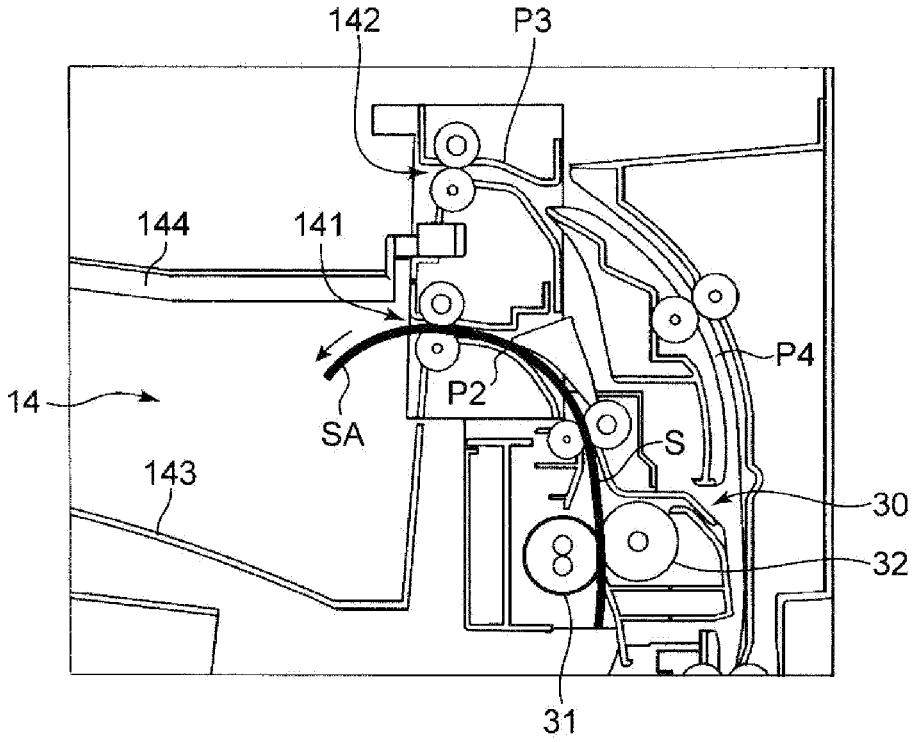
FIG. 22 is a cross sectional view of the vicinity of a sheet exit port of the image forming apparatus in one embodiment of the present disclosure.
Figure 23:
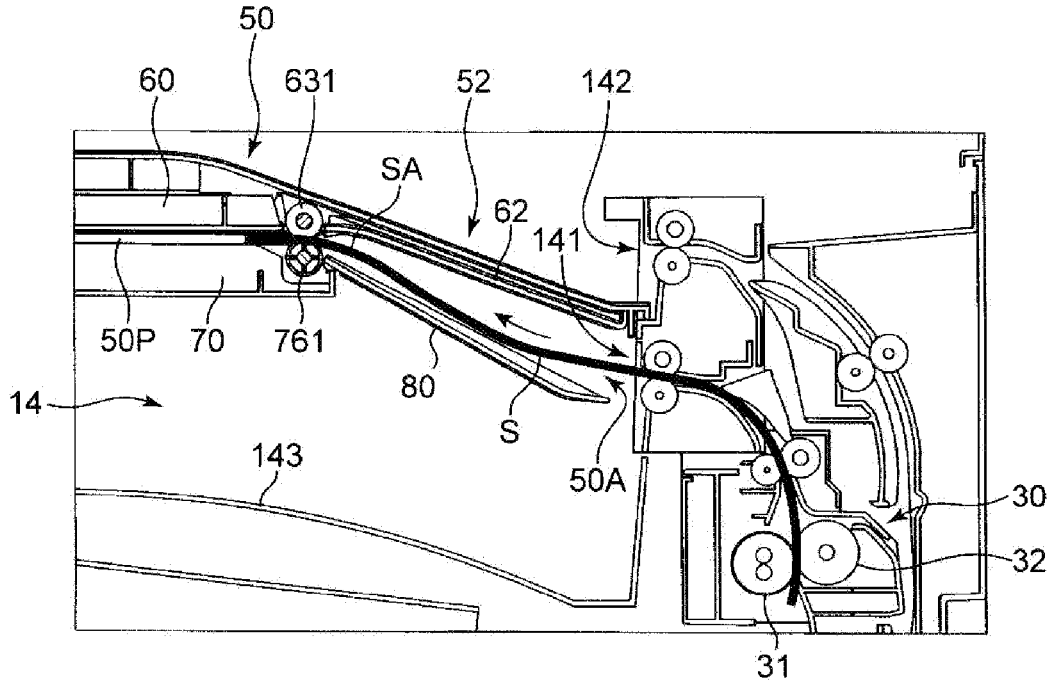
FIG. 23 is a cross sectional view of the vicinity of the sheet exit port of the image forming apparatus with the relay unit fitted in one embodiment of the present disclosure.

Further, according to the present embodiment, when a sheet is only passed through the relay unit 50, a curl of the sheet can be corrected. FIG. 22 is a cross sectional view of the vicinity of the first exit port 141 of the apparatus body 1. FIG. 23 is a cross sectional view of the vicinity of the first exit port 141 with the relay unit 50 fitted. The fusing section 30 includes the fusing roller 31 and the pressure roller 32. The heat source is built in the fusing roller 31. The pressure roller 32 forms a fusing nip in cooperation with the fusing roller 31.

As shown in the present embodiment, in an image forming apparatus for forming a monochrome image, a fusing roller formed of a rod heater inserted in an iron pipe is used as the fusing roller 31 in many cases. For example, an elastically deformable rubber roller is used as the pressure roller 32. When a sheet S passes a fusing nip formed by the fusing roller 31 and the pressure roller 32 to be heated and pressed, the fused sheet S tends to curl in a direction along the fusing roller 31.

As shown in FIG. 22, since the fusing roller 31 is arranged on the left side of the fusing nip, a tip end part SA of a sheet S in the conveyance direction, which is discharged from the first exit port 141, tends to curl downward.

In contrast thereto, the relay conveyance path 50P in the introduction section 52 of the relay unit 50 has a path inclined in a direction reverse to a direction in which a sheet S curls. The details are as follows. The relay conveyance path 50P in the introduction section 52 of the relay unit 50 is inclined upward as it goes downstream when viewed from the upstream end 50A. In other words, the inclined upper guide 62 and the guide plate 80 are inclined upward to the left. This inclination is inclination in a direction reverse to a direction in which the tip end part SA of a sheet S curls.

Downward curling by a sheet S discharged from the first exit port 141 is warped in an upward direction, which is reverse to the direction of the downward curling by the sheet S, during the time until the sheet S passes the relay conveyance path 50P inclined upward in the introduction section 52 and is nipped by the nip between the first conveyance roller 631 and the first follower roll 761. Accordingly, when a fused sheet S is only passed through the introduction section 52 of the relay unit 50, a curl of the sheet S can be corrected.

Figure 24:
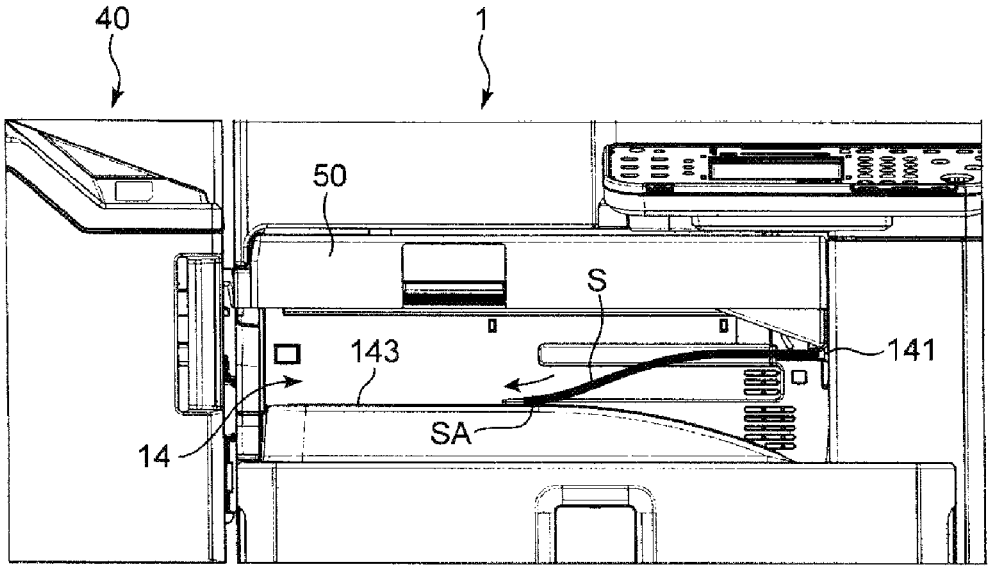
FIG. 24 is a front view of the peripheral part of an in-body discharge section of the image forming apparatus with the relay unit fitted in one embodiment of the present disclosure.
Figure 25:
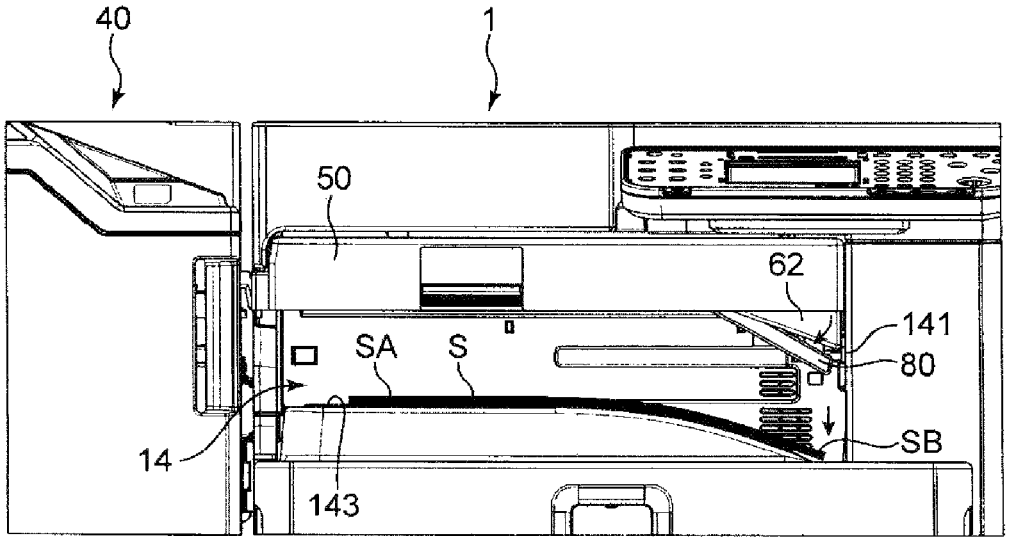
FIG. 25 is a front view showing a state in which the guide plate performs a hitting operation on a sheet, the state being changed from the state in FIG. 24.

FIGS. 24 and 25 are illustrations for explaining modified examples of the present disclosure. In the modified examples, the drive motor 65 changes the posture of the guide plate 80 from the second posture to the first posture after the tip end part of a sheet S passes the upstream end part of the introduction section 52 in discharging the sheet S to the in-body discharge tray 143 from the first exit port 141. Then, the drive motor 65 makes the guide plate 80 perform an auxiliary operation in discharge of the sheet S onto the in-body discharge tray 143. The details are as follows.

When a sheet S is discharged to the in-body discharge tray 143, the rear end part of the sheet S in the conveyance direction may not be entirely removed from a nip formed by a pair of discharge rollers arranged near the first exit port 141 and remains in the first exit port 141 in some cases. In particular, when the amount of sheets loaded on the in-body discharge tray 143 is large, the problem of the remaining rear end part of a sheet S in the conveyance direction is significant. In this case, a sheet jam, improper sheet loading, improper order of loaded sheets, etc. may occur.

Accordingly, when the rear end part of a sheet S in the conveyance direction passes through the first exit port 141, the guide plate 80 swings downward to hit the sheet S, thereby forcedly dropping the sheet S.

FIG. 24 shows a state in which a sheet S is being discharged from the first exit port 141 to the in-body discharge tray 143. Herein, while the tip end part SA of the sheet S is grounded to the in-body discharge tray 143, the rear end part SB has not passed through the first exit port 141 yet. This sheet conveyance path corresponds to the second path in the above described embodiment. The guide plate 80 takes the second posture with the upstream end 50A closed.

FIG. 25 is a drawing showing a state in which discharge of a sheet S has been progressed from the state in FIG. 24 and the guide plate 80 has just hit the sheet S. When the rear end part SB of the sheet S passes through the first exit port 141, the controller 651 (FIG. 10) makes the guide plate 80 perform an auxiliary operation for sheet discharge. That is, the controller 651 makes the drive motor 65 to operate to temporarily change the posture of the guide plate 80 from the second posture to the first posture for opening the upstream end 50A and to make the guide plate 80 hit the rear end part SB of a sheet S. Accordingly, hitting a sheet S being discharged from the first exit port 141 can forcedly cause the sheet S to fall onto the in-body discharge tray 143. Thus, problems accompanied by accumulation of sheets S on the first exit port 141 can be obviated.

One embodiment of the present disclosure has been described above. However, the present disclosure is not limited to this. For example, following modified examples may be employed.

(1) In the above described embodiment, the torsion coil spring 91 is used as a specific example of a transmission member. Alternatively, a torque limiter can be interposed at an appropriate position between the first shaft 641 and the power transmission mechanism 66.

(2) In the above described embodiment, the arrangement of the relay unit 50 in the upper region of the in-body space of the in-body discharge section 14 has been shown as an example. Alternatively, the relay unit 50 may be arranged in the lower region of the in-body space, and the guide plate 80 may be arranged as the top surface of the relay unit 50 or arranged on the top surface side of the relay unit 50. In this case, the receiving tray 50T serves as the in-body discharge tray 143. In this alteration, the second exit port 142 can be omitted. It is noted that the second path corresponds to a path in which a sheet is discharged to the upper surface (receiving tray 50T) of the relay unit 50 from the first exit port 141 via the upper region.

(3) In the above described embodiment, the relay unit 50 including the main body 51 with a horizontal conveyance path and the introduction section 52 with an inclined conveyance path has been shown as an example. Alternatively, the relay conveyance path 50P of the relay unit 50 may be horizontal across its entirety, or may be inclined across its entirety.

(4) According to the present disclosure, the drive device (drive motor 65) for rotating the conveyance roller (first conveyance roller 631) for sheet conveyance is mounted in the relay unit (relay unit 50). Further, the drive force of the drive device changes the posture of the guide plate (guide plate 80) to switch the sheet conveyance path. Accordingly, it is not necessary to provide a dedicated drive source to change the posture of the guide plate.

(5) According to the present disclosure, the switching operation of the guide plate (guide plate 80) can switch the sheet conveyance path between the path for post processing via the relay unit (relay unit 50) and the path continuing to the other locations.

(6) According to the present disclosure, a sheet discharged from the first exit port (first exit port 141) can move toward the first path (path in which the sheet conveyance path continues to the post processing device 40 via the relay unit 50) or toward the second path (path in which the sheet conveyance path continues to the in-body discharge tray 143). In addition, a sheet can be guided to a different path also from the second exit port (second exit port 142). Thus, various sheet conveyance paths can be used. Further, since the receiving tray (receiving tray 50T) for sheet is provided on the upper surface of the relay unit (relay unit 50), the receiving tray can be used as a sheet switchback conveyance path when duplex printing is performed on a sheet, for example.

(7) According to the present disclosure, the rotation of the shaft (first shaft 641) serving as the rotational axis of the conveyance roller (first conveyance roller 631) changes the posture of the guide plate (guide plate 80). Also, the posture of the guide plate (guide plate 80) can be changed between the first posture (posture of the guide plate 80 swinging downward) and the second posture (posture of the guide plate 80 swinging upward) according to the rotational direction of the shaft. Accordingly, only control of the rotational direction of the shaft by the drive device (drive motor 65) can switch the sheet conveyance path.

(8) According to the present disclosure, when the sheet conveyance path serves as the first path passing through the relay unit (relay unit 50), the conveyance roller (first conveyance roller 631) spontaneously rotates in the direction in which a sheet is conveyed. Thus, this is favorable.

(9) According to the present disclosure, a sheet guided by the guide plate (guide plate 80) to the second path is discharged to the in-body discharge tray (in-body discharge tray 143) arranged in the lower region of the in-body space. Accordingly, changing of the postures of the guide plate can result in switching between discharge of an image formed sheet to the in-body discharge tray and sending of the sheet toward the post processing device via the relay unit.

(10) According to the present disclosure, the guide plate (guide plate 80) forms the lower guide of the introduction section (introduction section 52). The guide plate swings about the shaft (first shaft 641) as a rotational axis to open/close the upstream end (upstream end 50A) of the relay conveyance path (relay conveyance path 50P). Accordingly, the structure of the guide plate and its driving mechanism can be simplified.

(11) According to the present disclosure, transmission of the rotational force to the guide plate (guide plate 80) from the shaft (first shaft 641) can be restricted by the transmission member (torsion coil spring 91). Thus, a range of swinging accompanied by the posture change of the guide plate can be restricted within an appropriate range.

(12) According to the present disclosure, the function of the transmission member can achieved with a simple structure in which the torsion coil spring (torsion coil spring 91) is inserted in the shaft (first shaft 641).

(13) According to the present embodiment, when a fused sheet is only passed through the introduction section (introduction section 52) of the relay unit (relay unit 50), a curl of the sheet can be corrected.

(14) According to the present disclosure, the swingable guide plate (guide plate 80) hits a sheet being discharged from the first exit port (first exit port 141) to make the sheet forcedly fall onto the in-body discharge tray (in-body discharge tray 143). Thus, a sheet jam or the like accompanied by accumulation of sheets on the first exit port can be obviated.

(15) According to the present disclosure, when a sheet jam occurs in the relay unit (relay unit 50), the lower guide member (lower guide member 70) is turned to open the relay conveyance path (relay conveyance path 50P). Thus, the jam can be cleared easily.

What is claimed is:

1. An image forming apparatus, comprising:

an apparatus body configured to perform image forming processing on a sheet;

an in-body discharge section formed in the apparatus body as in-body space having an opening opened outward of the apparatus body and capable of accommodating the sheet on which the image forming processing has been performed;

a first exit port formed in the apparatus body and opened toward the in-body space; and a relay unit detachably mounted in the in-body discharge section and configured to receive a sheet discharged from the first exit port and to convey the sheet, wherein the relay unit includes:

a relay conveyance path which the sheet passes;

a conveyance roller provided in the relay conveyance path and configured to convey the sheet in the relay conveyance path;

a drive device configured to rotate the conveyance roller; and a guide plate configured to switch a conveyance path for a sheet discharged from the first exit port between a first path via the relay unit and a second path other than the first path, and the drive device changes the posture of the guide plate between a first posture corresponding to the first path and a second posture corresponding to the second path.

2. An image forming apparatus according to claim 1, further comprising:

a post processing device in which a reception port for receiving a sheet is formed and which is mounted in the apparatus body, wherein the post processing device performs post processing on the sheet received at the reception port, and the relay unit receives a sheet from the first exit port and conveys the sheet to the reception port of the post processing device via the relay conveyance path.

3. An image forming apparatus according to claim 1, wherein a second exit port opened toward the in-body space is formed at a position higher than the position of the first exit port in the apparatus body, and an upper surface of the relay unit serves as a receiving tray for receiving at least part of a sheet discharged from the second exit port.

4. An image forming apparatus according to claim 1, wherein the relay unit includes:

a shaft as a rotational axis of the conveyance roller;

a main body configured to support the shaft and form a downstream portion of the relay conveyance path; and an introduction section arranged upstream of the shaft in a sheet conveyance direction to form an upstream portion of the relay conveyance path, the drive device rotates the shaft to rotate the conveyance roller, the guide plate includes:

an engagement portion with which the shaft is engaged rotatably; and a guide main body forming one of a pair of introduction guide surfaces which define the relay conveyance path in the introduction section, and the drive device rotates the shaft in the first direction to change the posture of the guide plate to the first posture to open an upstream end of the relay conveyance path, and rotates the shaft in the second direction, which is reverse to the first direction, to change the posture of the guide plate to the second posture to close the upstream end.

5. An image forming apparatus according to claim 4, wherein the first direction is a rotational direction in which the conveyance roller conveys a sheet to a downstream end of the relay conveyance path from the upstream end of the relay conveyance path.

6. An image forming apparatus according to claim 4, wherein the apparatus body includes an in-body discharge tray defining a bottom of the in-body space, the in-body space includes a lower region immediately above the in-body discharge tray and an upper region above the lower region, the relay unit is arranged in the upper region, and the second path is a path in which a sheet is discharged on the in-body discharge tray from the first exit port via the lower region.

7. An image forming apparatus according to claim 6, wherein the drive device changes the posture of the guide plate from the second posture to the first posture after a tip end part of a sheet passes an upstream end part of the introduction section in discharging the sheet to the in-body discharge tray from the first exit port.

8. An image forming apparatus according to claim 6, wherein the guide plate is arranged to face the in-body discharge tray.

9. An image forming apparatus according to claim 4, wherein the relay unit conveys a sheet in a horizontal direction, the relay unit includes:

an upper guide member forming an upper portion of the main body and including the introduction section; and a lower guide member forming a lower portion of the main body and arranged facing the upper guide member;

a lower surface of the upper guide member forms an upper guide surface of the relay conveyance path, and an upper surface of the lower guide member forms a lower guide surface of the relay conveyance path.

10. An image forming apparatus according to claim 9, wherein the relay unit further includes a joint member configured to join the lower guide member turnably to the upper guide member.

11. An image forming apparatus according to claim 4, wherein the relay unit further includes a transmission member configured to transmit rotational force of the shaft to the guide plate, the transmission member transmits the rotational force of the shaft to the guide plate in a range in which rotation of the guide plate is not restricted, while not transmitting the rotational force of the shaft to the guide plate in a state in which the rotation of the guide plate is restricted.

12. An image forming apparatus according to claim 11, wherein the transmission member is a torsion coil spring, the torsion coil spring includes:

a coil;

a first end portion extending from one end of the coil; and a second end portion extending from the other end of the coil the coil is inserted in the shaft to be integrally rotatable with the shaft, the guide plate further includes:

a first pressure section pressed by the first end portion in posture change of the guide plate to the first posture by the rotation in the first direction; and a second pressure section pressed by the second end portion in posture change of the guide plate to the second posture by the rotation in the second direction, the relay unit further includes:

a first restricting portion configured to restrict rotation of the guide plate in the first direction; and a second restricting portion configured to restrict rotation of the guide plate in the second direction, and the guide plate abuts on the first restricting portion or on the second restricting portion to loosen the coil.

13. An image forming apparatus according to claim 4, wherein the apparatus body includes a fusing section configured to perform fusing by heating and pressing a sheet, the sheet subjected to the fusing is discharged from the first exit port, and the relay conveyance path in the introduction section of the relay unit includes a path inclined in a direction reverse to a direction in which the sheet curls.

14. An image forming apparatus according to claim 4, wherein the in-body space includes a lower region and an upper region above the lower region along a perpendicular line, the relay unit is arranged in the lower region, and the second path is a path in which a sheet is discharged onto the upper surface of the relay unit from the first exit port via the upper region.

15. An image forming apparatus according to claim 14, wherein the guide plate is arranged as a top surface of the relay unit or arranged on a top surface side of the relay unit.

* * * * *